US008594545B2

(12) United States Patent
Kamijo et al.

(10) Patent No.: US 8,594,545 B2
(45) Date of Patent: Nov. 26, 2013

(54) IMAGE-FORMING DEVICE AND IMAGE-FORMING METHOD

(75) Inventors: Koichi Kamijo, Nagano (JP); Shinichi Tanaka, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 13/106,465

(22) Filed: May 12, 2011

(65) Prior Publication Data

US 2011/0286774 A1 Nov. 24, 2011

(30) Foreign Application Priority Data

May 19, 2010 (JP) ..... 2010-115524

(51) Int. Cl.
*G03G 15/01* (2006.01)

(52) U.S. Cl.
USPC ..... 399/304

(58) Field of Classification Search
USPC ..... 399/304, 305, 318
See application file for complete search history.

(56) References Cited

U.S. PATENT DOCUMENTS

| | | | | | |
|---|---|---|---|---|---|
| 3,612,677 | A | * | 10/1971 | Langdon et al. | 399/304 |
| 4,723,145 | A | * | 2/1988 | Takada et al. | 399/304 X |
| 4,875,069 | A | * | 10/1989 | Takada et al. | 399/304 |
| 4,935,776 | A | * | 6/1990 | Fukui | 399/304 X |
| 2010/0031837 | A1 | | 2/2010 | Feygelman et al. | |

FOREIGN PATENT DOCUMENTS

| | | | |
|---|---|---|---|
| JP | 2006-513883 | T | 4/2006 |
| WO | WO-2004/067277 | A1 | 8/2004 |

* cited by examiner

*Primary Examiner* — Sandra Brase
(74) *Attorney, Agent, or Firm* — Global IP Counselors, LLP

(57) ABSTRACT

An image-forming device includes an image carrier belt, a roller, a transfer material transporting member, and a transfer roller. The image carrier belt carries an image. The transfer material transporting member transports a transfer material. The transfer roller transfers the image to the transfer material at a nip. The transfer roller includes a concaved portion formed on a peripheral surface thereof and a transfer material gripping portion that grips the transfer material in the concaved portion. The transfer roller is in contact with the roller via the image carrier belt. A first interaxial distance between a rotation axis of the transfer roller and a rotation axis of the roller as the transfer material is gripped is larger than a second interaxial distance between the rotation axis of the transfer roller and the rotation axis of the roller as the image is being transferred onto the transfer material at the nip.

8 Claims, 14 Drawing Sheets

(A) (B)

IMAGE-FORMING DEVICE AND IMAGE-FORMING METHOD

CROSS-REFERENCE TO RELATED APPLICATIONS

This application claims priority to Japanese Patent Application No. 2010-115524 filed on May 19, 2010. The entire disclosure of Japanese Patent Application No. 2010-115524 is hereby incorporated herein by reference.

BACKGROUND

1. Technical Field

The present invention relates to an image-forming device and an image-forming method, in which a latent image formed on a photoreceptor is developed using a toner, the developed toner image is transferred onto a transfer belt, the toner image on the transfer belt is transferred onto a recording paper or another medium, the transferred toner image on the medium is fused and fixed, and an image is formed.

2. Background Technology

Regarding conventional image-forming devices, there is known a technique in which a concaved portion provided to a body part of a transfer roller is provided with a pawl member and a pawl seat member capable of gripping an edge part of a transfer material along the axial direction of the rollers, wherein a toner image formed on an intermediate transfer member or a similar element is transferred to the transfer material while the transfer material is gripped by the pawl member and the pawl seat member. An example of an application of this technique is described in Patent Citation 1 (Japanese Translation of PCT International Application No. 2006-513883). In Patent Citation 1, there is disclosed an image-forming device in which the transfer material is gripped, during transfer, by a gripping member provided to a concaved portion of a transfer roller; and the transfer material is released after transfer is complete. According to a conventional image-forming device such as that described above, it is possible to prevent the transfer material from becoming displaced during transfer, and to perform the transfer in a reliable manner.

Japanese Translation of PCT International Application No. 2006-513883 (Patent Document 1) is an example of the related art.

SUMMARY

Problems to Be Solved by the Invention

In a device in which a transfer is performed by passing a transfer material through a nip formed between a transfer roller and a transfer belt, where the transfer roller has, on a concaved portion provided to a body part, a gripping mechanism including a pawl member and a pawl seat member for gripping an edge part of a transfer material along the axial direction of the rollers, the space between the transfer roller and the transfer belt is restricted, and the clearance (i.e., the opening amount) in which the gripping member grips the transfer material is therefore also restricted. Therefore, in a device of such description, a problem is presented in that it becomes difficult to grip, in a stable manner, the transfer material being fed from a feed member for feeding the transfer material, and the transfer material may fail to be gripped. In particular, in an instance in which the gripping of the transfer material is performed in the vicinity of the nip between the transfer roller and the transfer belt, a problem is also presented in that the clearance is restricted, making the transfer material grip failure more likely.

Means Used to Solve the Above-Mentioned Problems

In order to solve the above-mentioned problems, an image-forming device includes an image carrier belt, a roller, a transfer material transporting member, and a transfer member. The image carrier belt carries an image. The roller winds the image carrier belt. The transfer material transporting member transports a transfer material. The transfer roller transfers the image to the transfer material at a nip. The transfer roller includes a concaved portion formed on a peripheral surface thereof and a transfer material gripping portion that grips the transfer material in the concaved portion. The nip is formed between the transfer roller and the roller. The transfer roller is in contact with the roller via the image carrier belt. A first interaxial distance between a rotation axis of the transfer roller and a rotation axis of the roller as the transfer material is gripped by the transfer material gripping portion is larger than a second interaxial distance between the rotation axis of the transfer roller and the rotation axis of the roller as the image is being transferred onto the transfer material at the nip.

DETAILED DESCRIPTION OF EXEMPLARY EMBODIMENTS

Figure 1:
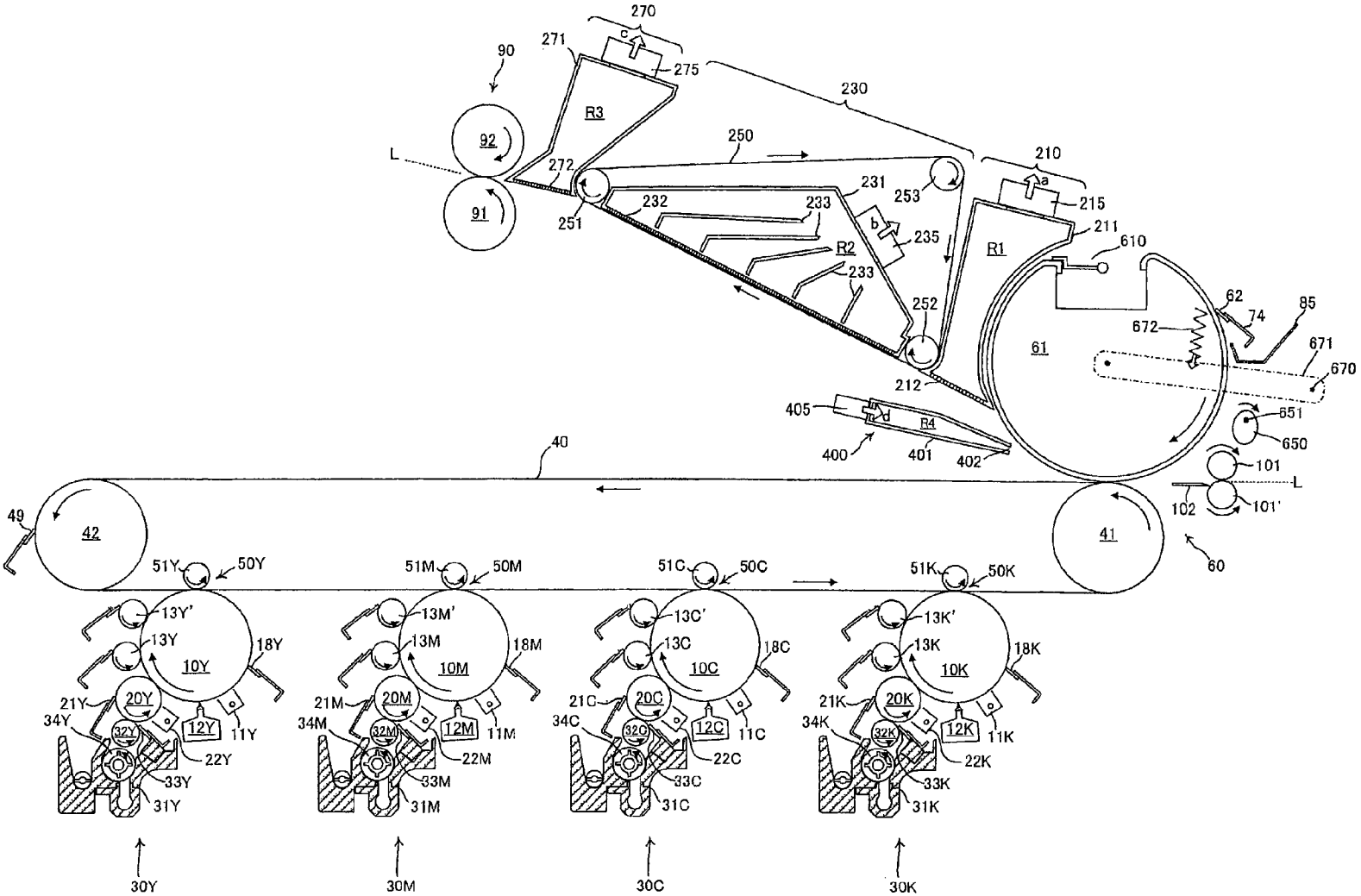
FIG. 1 is a drawing showing main constituent elements forming an image-forming device according to an embodiment of the present invention.

Embodiments of the invention will now be described with reference to the accompanying drawings. FIG. 1 is a drawing showing main constituent elements forming an image-forming device according to an embodiment of the invention. In relation to image-forming portions of each color arranged at a center section of the image-forming device, developing devices 30Y, 30M, 30C, 30K are arranged at a lower portion of the image-forming device; and a transfer belt 40, a secondary transfer unit (secondary transfer unit) 60, a fixing unit 90, and other structures are arranged at an upper portion of the image-forming device. In particular, the fixing unit 90 is disposed above the transfer belt 40, thereby making it possible to minimize the area of installation of the entire image-forming device. The present embodiment is configured so that a paper sheet or another transfer material that has been subjected to secondary transfer in the secondary transfer unit 60 is transported towards the fixing unit 90 while being subjected to suction by a transfer material transporting device 230, suction devices 210, 270, and related elements, making it possible to achieve a layout of such description.

The developing devices 30Y, 30M, 30C, 30K include photoreceptors 10Y, 10M, 10C, 10K; corona chargers 11Y, 11M, 11C, 11K; LED arrays or other exposure units 12Y, 12M, 12C, 12K; and other devices for forming an image by using a toner. The corona chargers 11Y, 11M, 11C, 11K cause the photoreceptors 10Y, 10M, 10C, 10K to be uniformly charged, the exposure units 12Y, 12M, 12C, 12K perform exposure according to an inputted image signal, and an electrostatic latent image is formed on the charged photoreceptors 10Y, 10M, 10C, 10K.

In brief, the developing devices 30Y, 30M, 30C, 30K include development rollers 20Y, 20M, 20C, 20K; developer containers (reservoirs) 31Y, 31M, 31C, 31K for storing liquid developers for each of the colors of yellow (Y), magenta (M), cyan (C), and black (K); anilox rollers 32Y, 32M, 32C, 32K, which are application rollers for applying the liquid developer for each of the colors from the developer containers 31Y, 31M, 31C, 31K onto the development rollers 20Y, 20M, 20C, 20K; and other components; and develop the electrostatic latent image formed on the photoreceptors 10Y, 10M, 10C, 10K by using the liquid developer for each of the colors.

The transfer belt 40 is an endless belt, which is stretched by belt-stretching rollers 41, 42, and rotatably driven while being caused to come into contact with the photoreceptors 10Y, 10M, 10C, 10K at primary transfer portions 50Y, 50M, 50C, 50K. Of the two belt-stretching rollers 41, 42, the belt-stretching roller 41 is a drive roller having a motor or another driving portion (not shown). Rotation of the belt-stretching roller 41 rotatably drives the transfer belt 40. Primary transfer rollers 51Y, 51M, 51C, 51K are arranged opposite the primary transfer portions 50Y, 50M, 50C, 50K with the photoreceptors 10Y, 10M, 10C, 10K and the transfer belt 40 therebetween. The primary transfer portions 50Y, 50M, 50C, 50K sequentially layer and transfer the developed toner image of each color on the photoreceptors 10Y, 10M, 10C, 10K onto the transfer belt 40, and form a full-color toner image, with positions of contact with the photoreceptors 10Y, 10M, 10C, 10K being transfer positions.

A secondary transfer roller 61, arranged opposite the belt-stretching roller 41 with the transfer belt 40 therebetween, and a cleaning device including a secondary roller cleaning blade 62 are provided to the secondary transfer portion. A monochromatic toner image or a full-color toner image formed on the transfer belt 40 is transferred, at a transfer position at which the secondary transfer roller 61 is arranged, onto a paper sheet, a film, a cloth, or another transfer material transported along a transfer material transport path L. The secondary transfer unit 60 includes all structures necessary to transfer the toner image formed on the transfer belt 40 onto the transfer material in a nip formed between the transfer belt 40 and the secondary transfer roller 61. Specifically, the secondary transfer unit 60 includes, for example, bias application means (not shown) for applying a potential difference between the secondary transfer roller 61 and the belt-stretching roller 41 and inducing movement of the toner image.

A configuration for urging the secondary transfer roller 61 in the present embodiment will now be described. In the secondary transfer unit 60, a roller shaft portion 602 of the secondary transfer roller 61 is pivotally mounted at both ends on frame members 671. Each of the frame members 671 is capable of pivoting about a pivot support shaft portion 670, and urging members 672 urge the frame members 671 in the direction indicated by the arrow in the drawing (i.e., downwards). In the second embodiment, the structure of the above description urges the secondary transfer roller 61 towards the belt-stretching roller 41 and makes it possible to apply a predetermined transfer load on the secondary transfer nip between the secondary transfer roller 61 and the belt-stretching roller 41. The transfer load and the transfer bias in the secondary transfer nip make it possible to transfer toner particles on the transfer belt 40 to the side of the transfer material in the secondary transfer nip in an efficient manner.

Two position regulating members 650 that rotate about a rotation shaft 651 in synchronization with the rotation of the secondary transfer roller 61 are likewise provided substantially below the two frame members 671 so as to correspond with the frame members 671. The position regulating members 650 function as a cam having a predetermined profile. The position regulating members 650 come into contact with the frame members 671 at a predetermined phase during rotation, thereby controlling the distance between an axial center of the secondary transfer roller 61 and an axis center of the belt-stretching roller 41.

In the claims, the structure that includes the position regulating members 650 and the frame members 671 is superordinated and referred to as an "axial-interaxial distance regulating portion." Also, in the claims, the position regulating member 650 is referred to as a "first regulating member" and the frame member 671 is referred to as a "second regulating member."

The first suction device 210, the transfer material transporting device 230, and the second suction device 270 are sequentially arranged downstream of the transfer material transport path L and configured to transport the transfer material to the fixing unit 90. In the fixing unit 90, the monochromatic toner image or the full-color toner image transferred onto the paper sheet or another transfer material is fused and fixed onto the paper sheet or another transfer material.

A cleaning device including a transfer belt cleaning blade 49 for cleaning the transfer belt 40 is arranged so as to come into contact with the transfer belt 40 at the location at which the transfer belt 40 is stretched by a belt-stretching roller 42, so that any remaining toner and carrier on the transfer belt 40 are cleaned off The driving force for driving the transfer belt 40 may also be applied through the belt-stretching roller 42.

Feeding of the transfer material into the image-forming device is performed by a paper-feeding device (not shown). The transfer material that has been positioned in the paper-feeding device is fed into the transfer material transport path L, one sheet at a time, at a predetermined timing. In the transfer material transport path L, the transfer material is transported to the secondary transfer position by gate rollers 101, 101' and a transfer material guide 102, and the developed monochromatic toner image or the developed full-color toner image formed on the transfer belt 40 is transferred onto the transfer material. As described above, the transfer material that has undergone secondary transfer is further transported to the fixing unit 90 by the transfer material transporting means, which mainly includes the transfer material transporting device 230. The fixing unit 90 includes a heating roller 91 and a pressure-applying roller 92, which is urged towards the heating roller 91 at a predetermined pressure. The fixing unit 90 passes the transfer material through a nip between the heating roller 91 and the pressure-applying roller 92, and fuses and fixes the monochromatic toner image or the full-color toner image, which has been transferred onto the transfer material, onto the paper sheet or another transfer material.

A description will now be given for the developing devices. Since the configuration of the image-forming portion and the developing device for each of the colors is identical, a description will be given for the image-forming portion and the developing device for yellow (Y).

In the image-forming portion, a photoreceptor cleaning blade 18Y, the corona charger 11Y, the exposure unit 12Y, the development roller 20Y of the developing device 30Y, a first photoreceptor squeeze roller 13Y, and a second photoreceptor squeeze roller 13Y' are arranged along a direction of rotation of an outer circumference of the photoreceptor 10Y.

The photoreceptor cleaning blade 18Y, which is in contact with the photoreceptor 10Y, cleans off any remaining liquid developer that has not been transferred at the first transfer portion on the photoreceptor 10Y.

A cleaning blade 21Y, the anilox roller 32Y, and a compaction corona generator 22Y are arranged along the outer circumference of the development roller 20Y of the developing device 30Y. A regulating blade 33Y for adjusting the amount of liquid developer fed to the development roller 20Y is in contact with the anilox roller 32Y. An auger 34Y is accommodated in the liquid developer container 31Y. Also, the primary transfer roller 51Y of the primary transfer portion is arranged in a position opposite the photoreceptor 10Y so as to sandwich the transfer belt 40 therebetween.

The photoreceptor 10Y is a photoreceptor drum including a cylindrical member with an amorphous silicon photoreceptor or another photoreceptor layer formed on the outer peripheral surface. The photoreceptor 10Y rotates in the clockwise direction.

The corona charger 11Y is arranged upstream in the direction of rotation of the photoreceptor 10Y from the nip portion formed between the photoreceptor 10Y and the development roller 20Y; a voltage is applied from a power source unit (not shown), and the photoreceptor 10Y is charged with a corona discharge. The exposure unit 12Y lies downstream from the corona charger 11Y in the direction of rotation of the photoreceptor 10Y. The exposure unit 12Y emits light onto the surface of the photoreceptor 10Y that has been charged by the corona charger 11Y, and forms a latent image on the photoreceptor 10Y. From the beginning to the end of the image-forming process, rollers and other structures disposed in earlier stages are defined as being upstream relative to rollers and other structures disposed in later stages.

The developing device 30Y includes the compaction corona generator 22Y for performing a compaction action, and the developer container 31Y for storing the liquid developer in a state in which the toner is dispersed within the carrier at a weight ratio of approximately 20%.

The developing device 30Y includes the development roller 20Y for carrying the liquid developer; the anilox roller 32Y, which is an application roller for applying the liquid developer onto the development roller 20Y; the regulating blade 33Y for regulating the amount of liquid developer applied to the development roller 20Y; the auger 34Y for feeding the liquid developer to the anilox roller 32Y while stirring and transporting the liquid developer; the compaction corona generator 22Y for placing the liquid developer carried on the development roller 20Y into a state of compaction; and the development roller cleaning blade 21Y for cleaning the development roller 20Y.

The liquid developer held in the developer container 31Y is a non-volatile liquid developer that is non-volatile at normal temperatures and has a high concentration and high viscosity, rather than being a volatile liquid developer that has Isopar (an Exxon brand) as its carrier, is volatile at normal temperatures, has a low concentration (approximately 1 to 3 wt %), and has a low viscosity, as has generally been used conventionally. Specifically, the liquid developer in the invention is a liquid developer that has a high viscosity (i.e., has a viscoelasticity of approximately 30 to 300 mPa·s at a shear rate of 1000 (1/s) at 25° C., as measured using a HAAKE RheoStress RS600), and has a toner solids concentration of approximately 15 to 25%, wherein solid particles of a pigment or another colorant dispersed within a thermoplastic resin are added to an organic solvent, a silicone oil, a mineral oil, a cooking oil, or another liquid solvent along with a dispersant, the solid particles having an average particle diameter of 1 μm.

The anilox roller 32Y functions as an application roller for supplying and applying the liquid developer to the development roller 20Y. The anilox roller 32Y is a cylindrical member, and is a roller whose surface is formed as an uneven surface by engraving fine channels in a uniform helical pattern on the surface so as to enable the surface to more readily carry the developer. The anilox roller 32Y feeds the liquid developer from the liquid developer container 31Y to the development roller 20Y. As shown in FIG. 1, when the device is in operation, the auger 34Y rotates in the counterclockwise direction and supplies the liquid developer to the anilox roller 32Y, while the anilox roller 32Y rotates in the counterclockwise direction, and applies the liquid developer onto the development roller 20Y.

The regulating blade 33Y is a metallic blade having a thickness of approximately 200 μm and is in contact with the surface of the anilox roller 32Y. The regulating blade 33Y regulates the film thickness and amount of the liquid developer that has been carried and transported by the anilox roller 32Y, and adjusts the amount of the liquid developer fed to the development roller 20Y.

The development roller cleaning blade 21Y is made of rubber or a similar material that makes contact with the surface of the development roller 20Y and is disposed downstream in the direction of rotation of the development roller 20Y relative to a development nip portion formed where the development roller 20Y makes contact with the photoreceptor 10Y. The development roller cleaning blade 21Y wipes off and removes liquid developer remaining on the development roller 20Y.

The compaction corona generator 22Y is electrical field application means for increasing the charge bias on the surface of the development roller 20Y. The compaction corona generator 22Y applies an electrical field from the compaction corona generator 22Y towards the development roller 20Y at a compaction portion. Note that the electrical field application means for this compaction may employ a compaction roller, rather than a corona discharge from a corona discharger as shown in FIG. 1.

The developer carried on the development roller 20Y and subjected to compaction is developed in correspondence with the latent image on the photoreceptor 10Y by a predetermined electrical field being applied at the developing nip portion where the development roller 20Y and the photoreceptor 10Y make contact with each other.

The developer remaining after developing is wiped off and removed by the development roller cleaning blade 21Y, whereupon the removed developer drops into a collection receptacle within the developer container 31Y, and is reused. Note that the carrier and toner reused in this manner are not in a mixed-color state.

A photoreceptor squeeze device arranged upstream from the primary transfer position is arranged downstream from the development roller 20Y, and facing the photoreceptor 10Y; the photoreceptor squeeze device collects the residual carrier of the toner image developed on the photoreceptor 10Y. This photoreceptor squeeze device includes the first photoreceptor squeeze roller 13Y and the second photoreceptor squeeze roller 13Y', both of which are made of elastic roller members that slide on the photoreceptor 10Y and rotate. The photoreceptor squeeze device has a function of collecting excess carrier and originally unnecessary fog toner from the toner image developed on the photoreceptor 10Y, and increasing the toner particle ratio within the visualized image (i.e., the toner image). Note that a predetermined bias voltage is applied to the photoreceptor squeeze rollers 13Y, 13Y'.

Having passed the squeeze device including the first photoreceptor squeeze roller 13Y and the second photoreceptor squeeze roller 13Y' mentioned above, the surface of the photoreceptor 10Y enters the primary transfer portion 50Y.

At the primary transfer portion 50Y, the developer image developed on the photoreceptor 10Y is transferred to the transfer belt 40 by the primary transfer roller 51Y. At this primary transfer portion, the effect of the transfer bias applied to the primary transfer roller 51 transfer the toner image on the photoreceptor 10 to the side of the transfer belt 40. Here, the configuration is such that the photoreceptor 10Y and the transfer belt 40 move at the same speed, reducing the driving load for rotation and movement as well as suppressing disturbance to the visualized toner image on the photoreceptor 10Y.

Magenta (M), cyan (C), and black (K) toner images are formed on the photoreceptors 10M, 10C, 10K, respectively, in the respective developing devices 30M, 30C, 30K, through the same process as the aforementioned developing process of the developing device 30Y. The transfer belt 40 passes through the nips of the primary transfer portions 50 for the colors yellow (Y), magenta (M), cyan (C), and black (K); the developer (i.e., the developed images) on the photoreceptor for each of the colors is transferred thereto and superimposed upon each other; and the transfer belt 40 enters into the nip portion of the secondary transfer unit 60.

Having passed the secondary transfer unit 60, the transfer belt 40 makes another pass in order to pick up a transfer image at the primary transfer portions 50. The transfer belt 40 is cleaned by the transfer belt cleaning blade 49 and other components, upstream from the primary transfer portions 50.

The transfer belt 40 has a three-layer structure, in which a polyurethane elastic intermediate layer is provided on a polyimide base layer, and a PFA surface layer is provided thereupon. This transfer belt 40 is used in a state of being stretched by the belt-stretching rollers 41, 42 on the side of the polyimide base layer, and the toner images are transferred on the side of the PFA surface layer.

Figure 2:
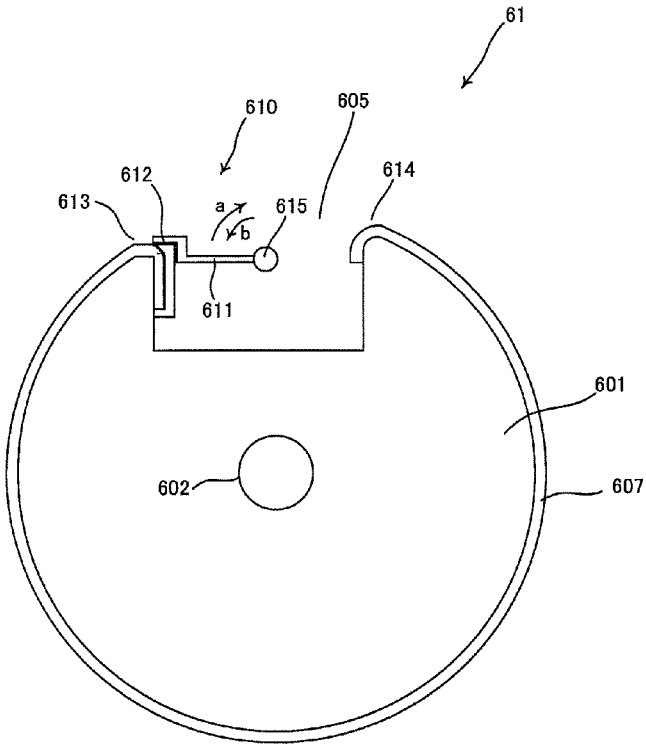
FIG. 2 illustrates a secondary transfer roller used in the image-forming device according to the embodiment of the present invention.

Next, the secondary transfer roller 61 used in the image-forming device according to the present embodiment will be described in further detail. FIG. 2 illustrates the secondary transfer roller used in the image-forming device according to the embodiment of the invention. In FIG. 2, 601 represents a roller body portion, 602 represents a roller shaft portion, 605 represents an opening concaved portion, 607 represents a sheet material, 610 represents a transfer material gripping mechanism, 611 represents a transfer material gripping pawl, 612 represents a pawl seat part, 613 represents a first opening edge, 614 represents a second opening edge, and 615 represents a gripping pawl pivot.

The roller shaft part 602 is provided at both end parts of the roller body part 601 of the secondary transfer roller 61. The roller body part 601 is mounted on the main device body side so as to be capable of pivoting about the roller shaft part 602. The opening concaved portion 605 extending along the axial direction is provided to the roller body part 601. The transfer material gripping mechanism 610 is provided in the opening concaved portion 605 between the first opening edge 613 and the second opening edge 614, and the sheet material 607 is provided to the portion of the roller body part 601 excluding the opening concaved portion 605.

The transfer material gripping mechanism 610 is a mechanism for gripping or releasing the transfer material. The sheet material 607 is a structure in which a polyimide base material layer having a thickness of 80 to 90 μm is coated with a fluororesin coating. The sheet material 607 also functions as a semiconducting layer having a predetermined electrical resistance component. Note that the thickness of the sheet material 607 is exaggerated in the drawing.

The sheet material 607 may be a polyimide base material layer having a thickness of 80 to 90 μm and having a fluororesin coating applied thereto as described above; or may be a polyimide base material layer having a thickness of 80 to 90 μm, having a urethane elastic layer of about 2 mm provided thereto, and having a fluororesin coating applied to the surface of the urethane elastic layer.

Transfer of the toner image from the transfer belt 40 and the transfer material is performed when the transfer material passes through the secondary transfer nip in a state in which the predetermined bias voltage is applied between the secondary transfer roller 61 and the belt-stretching roller 41 and the transfer material is wrapped around the sheet material 607 of the roller body part 601.

In brief, the transfer material gripping mechanism 610 includes a plurality of pairs of the transfer material gripping pawl 611 and the pawl seat part 612 provided in a dispersed manner along the axial direction of the roller. The transfer material gripping pawl 611 pivotally moves in the direction indicated by a or b in the drawing about a gripping pawl pivot 615, thereby making it possible to grip the edge part of the transfer material or release the gripped transfer material between the transfer material gripping pawl 611 and the pawl seat part 612.

The above-described structure including the transfer material gripping pawl 611 and the pawl seat part 612 for gripping the transfer material is a example of a transfer material gripping portion which includes both elements. The transfer material gripping pawl 611 is superordinated and an example of a transfer material gripping member (or gripping member). The pawl seat part 612 for supporting the transfer material gripping pawl 611 is defined as a support member.

If it is hypothetically assumed that an outer peripheral surface similar to the roller body part 601 is present at the opening concaved portion 605 of the secondary transfer roller 61 (i.e., a hypothetical peripheral surface whose distance from the roller shaft part 602 is equal to the distance between the peripheral surface of the roller body part 601 and the roller shaft part 602), the layout is configured so that the pawl seat part 612 is provided within the hypothetical outer peripheral surface. When the transfer material gripping pawl 611 is at a maximum pivoting position in the direction indicated by a, a part of the transfer material gripping pawl 611 extends outside the hypothetical peripheral surface.

Figure 3:
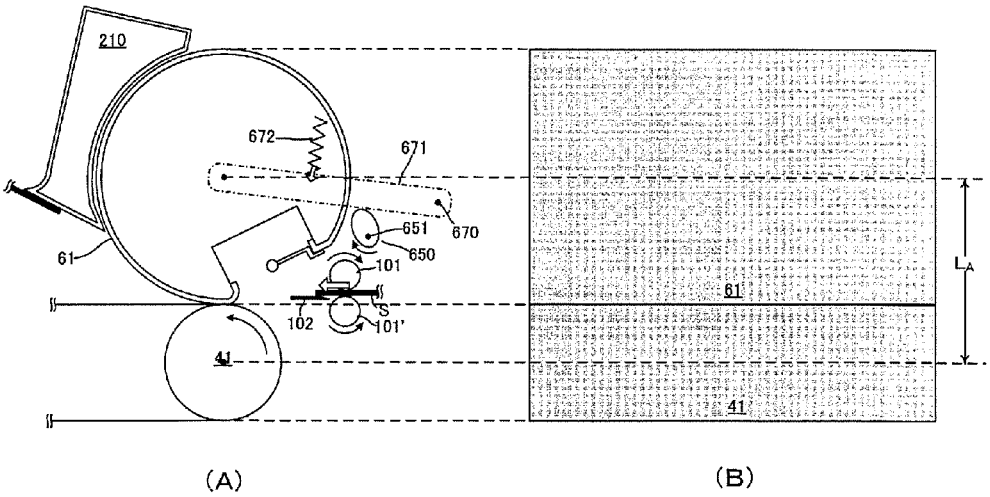
FIG. 3 illustrates an operation of a secondary transfer unit 60 used in the image-forming device according to the embodiment of the present invention.
Figure 8:
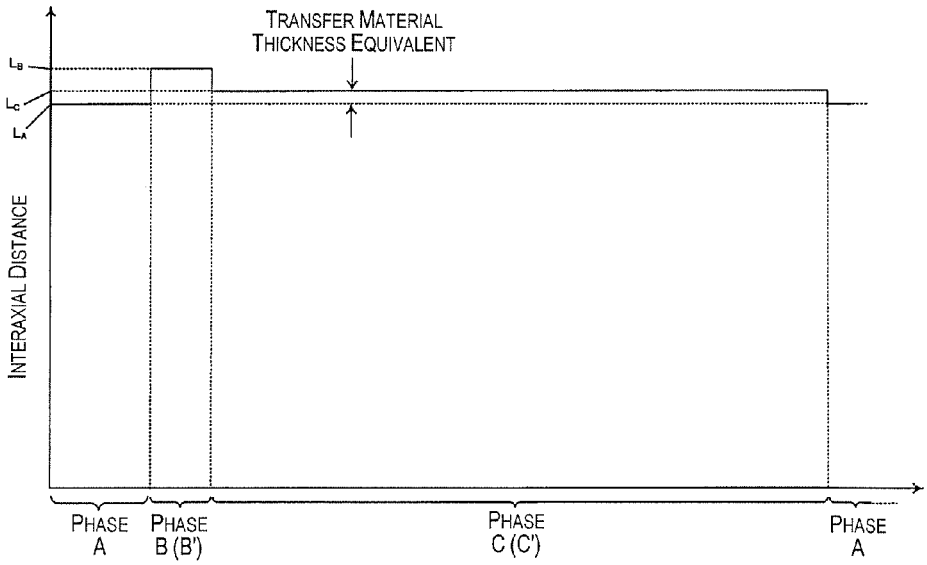
FIG. 8 illustrates the distance between the axial center of a secondary transfer roller 61 and a belt-stretching roller 41 in the image-forming device according to the embodiment of the present invention.

Next, a description will be given for an operation of the transfer material gripping mechanism 610 provided to the opening concaved portion 605 of the secondary transfer roller 61, and a position-regulating operation based on the regulating member 650. FIGS. 3 though 7 illustrate an operation of the secondary transfer unit 60 used in the image-forming device according to the embodiment of the invention. Each of the drawings (A) is a drawing in which the secondary transfer unit 60 is viewed from the axial direction of the rollers, and each of the drawings (B) is a schematic diagram in which the secondary transfer unit 60 is viewed from a direction that is perpendicular to the axis of the rollers. FIG. 8 illustrates the interaxial distance between the secondary transfer roller 61 and the belt-stretching roller 41 when the secondary transfer roller 61 is rotating. Note that in the present specification, rotation of the secondary transfer roller 61 may hereafter be expressed as a change in the phase of the secondary transfer roller 61 in accordance with the state of rotation.

FIG. 3 shows a state in which the transfer material S is approaching the secondary transfer roller 61 along the transfer material guide 102 (i.e., phase A in FIG. 8). Even in an instance in which printing is being performed continuously, in the phase shown in FIG. 3, neither transfer material that has already undergone transfer, nor any other transfer material, are present in the secondary transfer nip. In the phase shown in FIG. 3, the interaxial distance between the secondary transfer roller 61 and the belt-stretching roller 41 is in a state in which a predetermined distance $L_A$ is maintained. From this state, the regulating member 650 and the frame member 671 gradually start to contact each other, resulting in a state in which the regulating member 650 is subjected to an urging force/load from the secondary transfer roller 61 through the frame member 671. The transfer material gripping pawl 611 provided in the opening concaved portion 605 is thereby prevented from coming into contact with the transfer belt 40, even when the opening concaved portion 605 of the secondary transfer roller 61 arrives at a position facing the transfer belt 40.

Figure 4:
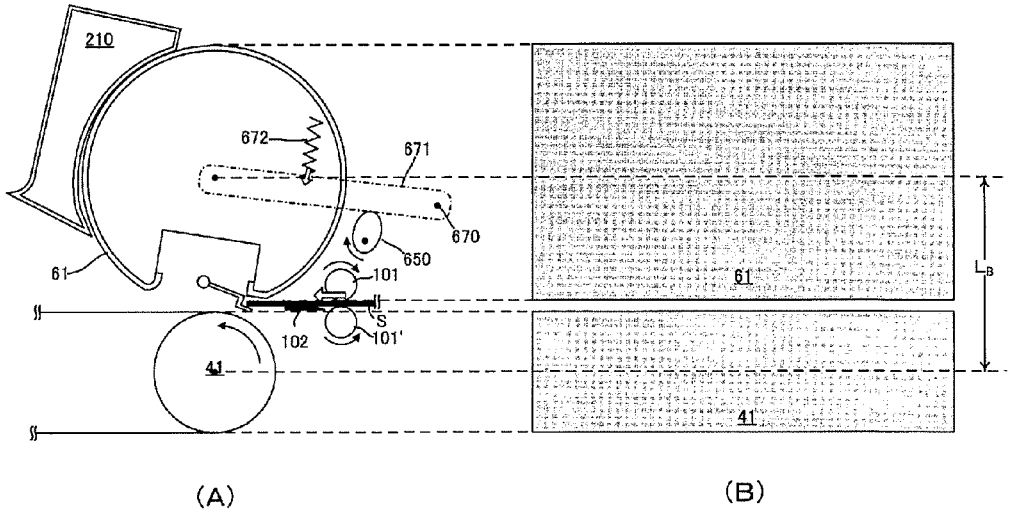
FIG. 4 illustrates an operation of the secondary transfer unit 60 used in the image-forming device according to the embodiment of the present invention.

FIG. 4 shows a state of readiness for gripping the transfer material S approaching along the transfer material guide 102 (i.e., phase B in FIG. 8). Specifically, the transfer material gripping pawl 611 starts to move away from the pawl seat part 612 so that the clearance for gripping the transfer material S widens. Although the opening concaved portion 605 of the secondary transfer roller 61 is in a state of facing the transfer belt 40, the regulating member 650 is in contact with the frame member 671, whereby there exists a state in which a predetermined distance of $L_B$ is maintained as the interaxial distance between the secondary transfer roller 61 and the belt-stretching roller 41. Although the secondary transfer roller 61 is urged in a downward direction, there exists a state in which the urging force/load from the secondary transfer roller 61 is received by the regulating member 650 through the frame member 671. As for the operation of the transfer material gripping mechanism 610 in the opening concaved portion 605, the transfer material gripping pawl 611 has moved away from the pawl seat part 612 and released the gripping part, and a state of readiness for gripping the transfer material S is in effect. However, contact between the regulating member 650 and the frame member 671 causes the interaxial distance $L_B$ to be longer than the interaxial distance $L_A$, therefore widening the clearance for gripping the transfer material S. Therefore, it becomes possible to grip, in a stable manner, the transfer material S fed from the gate rollers 101, 101' for feeding the transfer material S, and to reduce the incidence of transfer material grip failure. Also, since the interaxial distance $L_B$ is configured so as to be longer than the interaxial distance $L_A$, the transfer material gripping pawl 611, which has moved away from the pawl seat part 612, does not come into contact with the transfer belt 40.

Figure 5:
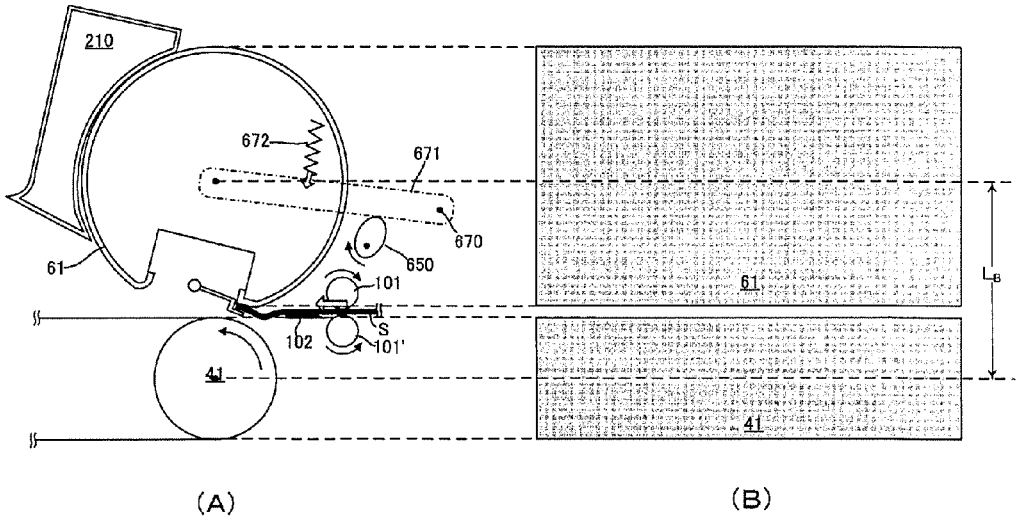
FIG. 5 illustrates an operation of the secondary transfer unit 60 used in the image-forming device according to the embodiment of the present invention.

FIG. 5 shows a state in which the transfer material gripping pawl 611 of the transfer material gripping mechanism 610 is closed, whereby the transfer material S is gripped (i.e., phase B' in FIG. 8). A configuration is present in which, in phase B', the regulating member 650 is again in contact with the frame member 671, whereby the distance of $L_B$ is maintained as the interaxial distance between the secondary transfer roller 61 and the belt-stretching roller 41. Having the interaxial distance be equal to interaxial distance $L_B$ makes it possible to prevent the transfer material gripping pawl 611 from coming into contact with the transfer belt 40 or to minimize occurrence of failure to grip the transfer material S, even when the transfer material gripping pawl 611 is undergoing a motion so as to grip the edge part of the transfer material S.

Figure 6:
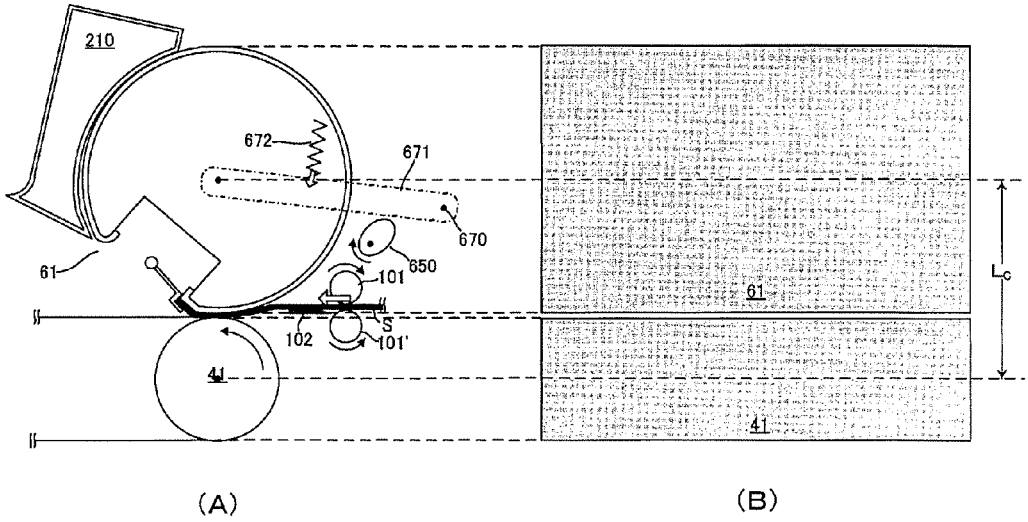
FIG. 6 illustrates an operation of the secondary transfer unit 60 used in the image-forming device according to the embodiment of the present invention.

FIG. 6 shows a state in which the transfer material S, which has been gripped by the transfer material gripping mechanism 610, is being transported beyond the secondary transfer nip (i.e., phase C in FIG. 8). The toner image layered on the transfer belt 40 is transferred onto the transfer material S passing through the secondary transfer nip. In phase C, the regulating member 650 and the frame member 671 are separated from each other, and the urging force/load from the secondary transfer roller 61 is directly acting as the transfer load. Although the regulating member 650 and the frame member 671 are not in contact with each other, the transfer material S passing through the secondary transfer nip is present in the secondary transfer nip. Therefore, a predetermined distance of $L_C$ is maintained as the interaxial distance between the secondary transfer roller 61 and the belt-stretching roller 41. The distance corresponding to the difference between the interaxial distance $L_A$ and the interaxial distance $L_C$ is the thickness of the transfer material S.

Thus, the invention is configured so that the interaxial distance between the rotation axis of the secondary transfer roller 61 and the rotation axis of the belt-stretching roller 41 when the transfer material S, which has been transported by the gate rollers 101, 101' (i.e., transfer material transporting members), is gripped by the transfer material gripping pawl 611 and the pawl seat part 612 is longer than the interaxial distance between the rotation axis of the secondary transfer roller 61 and the rotation axis of the belt-stretching roller 41 when an image is being transferred to the transfer material S at the secondary transfer nip. Therefore, it becomes possible to grip, in a stable manner, the transfer material S fed from the transfer material transporting member for feeding the transfer material S, and reduce the incidence of failure to grip the transfer material S.

Here, the interaxial distance is defined as the distance between a center of a rotation circle (rotation circle corresponding to a cross-section of a roller) and a center of a rotation circle (rotation circle corresponding to a cross-section of a roller), corresponding to, for example, interaxial distance $L_A$ in FIG. 3.

Figure 7:
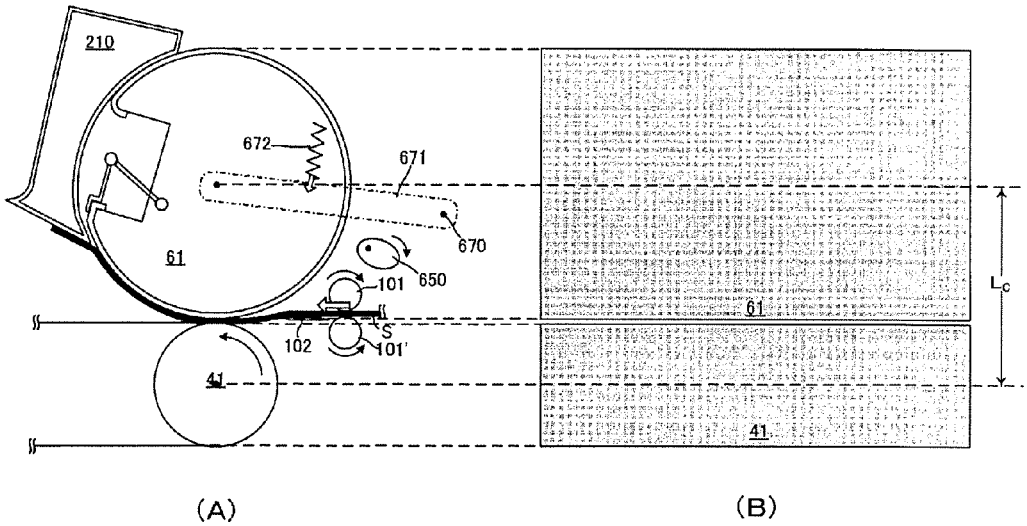
FIG. 7 illustrates an operation of the secondary transfer unit 60 used in the image-forming device according to the embodiment of the present invention.

FIG. 7 shows a state in which the transfer material gripping mechanism 610 has released the transfer material S and the transfer material S has been delivered to the transfer material transporting means provided further downstream (i.e., phase C' in FIG. 8). In phase C', again, the regulating member 650 and the frame member 671 are separated from each other, the urging force/load from the secondary transfer roller 61 acts as the transfer load, and the toner image layered on the transfer belt 40 is transferred on the transfer material S passing through the secondary transfer nip. Also, again in phase C, there exists a state in which a predetermined distance interaxial distance $L_C$ is maintained as the interaxial distance between the secondary transfer roller 61 and the belt-stretching roller 41.

Thus, according to the image-forming device (i.e., image-forming method) of the invention, the interaxial distance $L_B$ between the secondary transfer roller 61 and the belt-stretching roller 41 when the transfer material gripping pawl 611 grips the transfer material S is configured to be longer than the interaxial distance $L_C$ between the secondary transfer roller and the belt-stretching roller when the transfer material S is present between the secondary transfer roller 61 and the transfer belt 40. It thereby becomes possible to grip, in a stable manner, the transfer material S fed from the feeding member for feeding the transfer material S, and to reduce the incidence of failure to grip the transfer material S.

Figure 9:
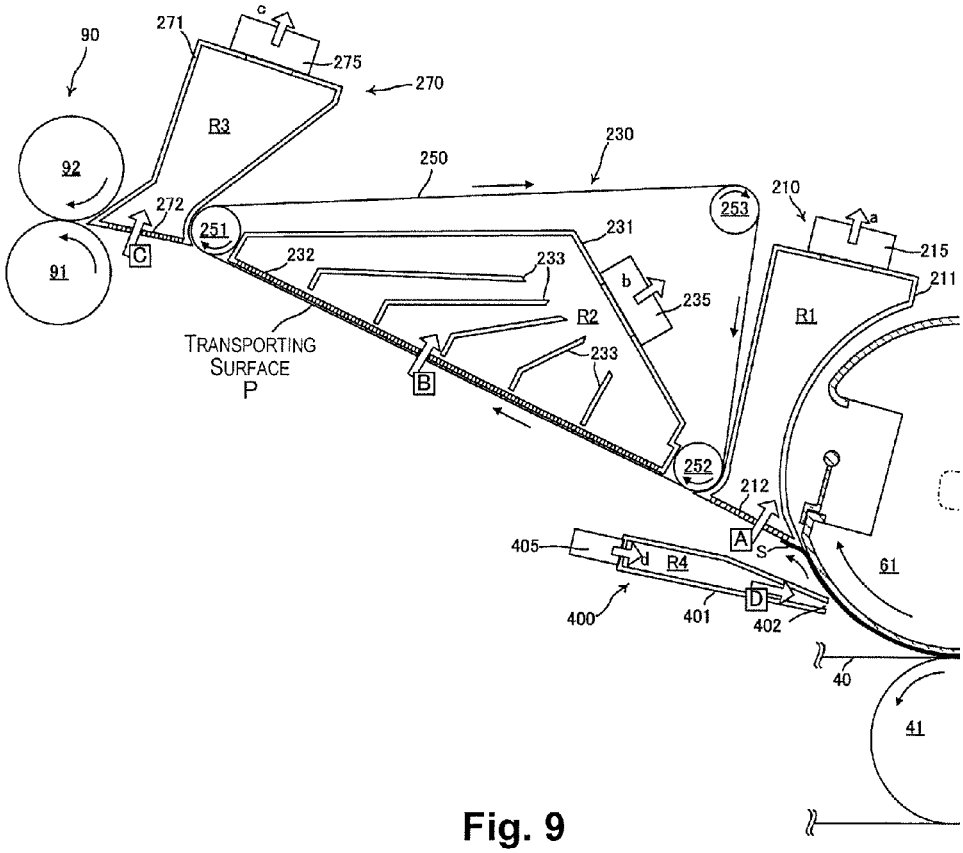
FIG. 9 illustrates an operation of transfer material transporting means used in the image-forming device according to the embodiment of the present invention.
Figure 10:
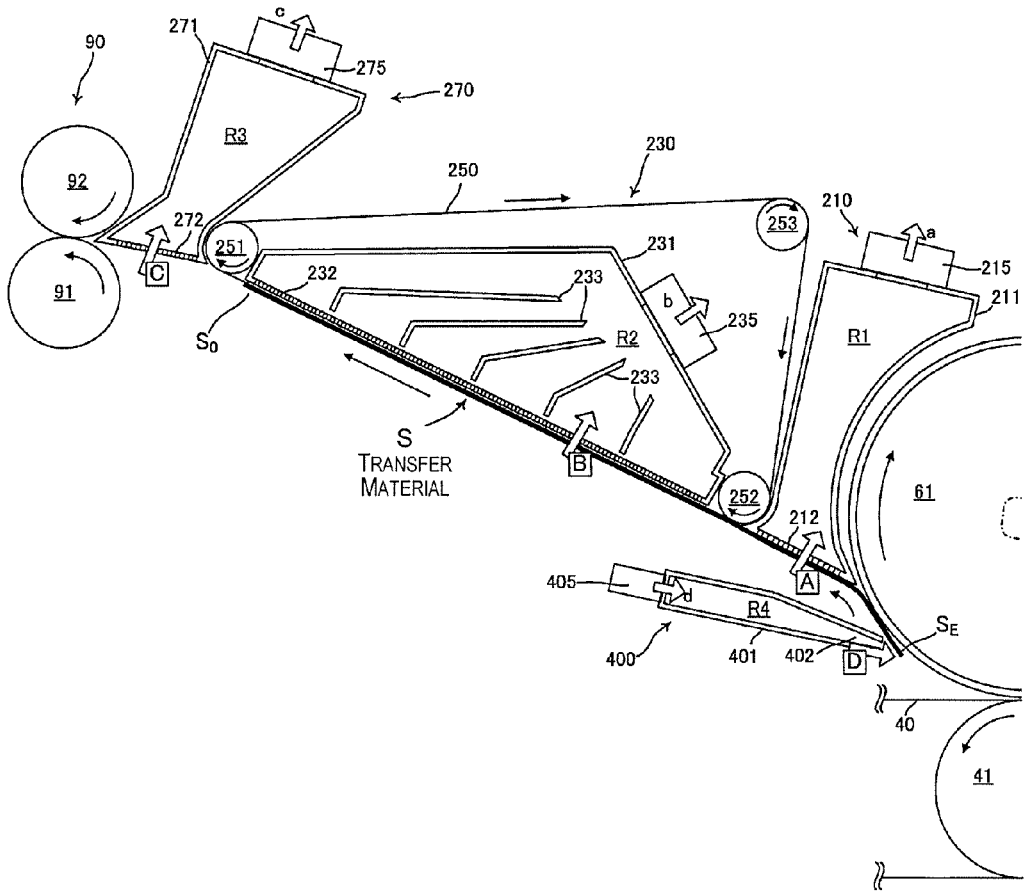
FIG. 10 illustrates an operation of transfer material transporting means used in the image-forming device according to the embodiment of the present invention.

The transfer material S, which has been freed by the transfer material gripping mechanism 610 as described above, is then transported to the fixing unit 90. The transporting means for performing this transporting will now be described. FIGS. 9 and 10 are drawings illustrate an operation of the transfer material transporting means used in the image-forming device according to the embodiment of the invention.

The first suction device 210 has a case part 211, on which is mounted a sirocco fan or another airflow generating portion 215. The airflow generating portion 215 is capable of expelling air from a space R1 in the case part 211 to the exterior of the case part 211. A bottom surface of the case part 211 is a suction surface 212 having a plurality of air vents provided across the surface. The first suction device 210 operates the airflow generating portion 215 and expels air to the exterior of the case part 211 as indicated by a, thereby generating an airflow as indicated by A. This airflow causes the transfer material S, onto which the toner image has been transferred, to be held on the suction surface 212 against gravity. The strength of the airflow is of a degree that causes the transfer material S to be held on the suction surface 212, but is not of a degree that counteracts the force by which the transfer material S is pushed out of the secondary transfer nip and impedes the onward movement of the transfer material S.

In brief, the transfer material transporting device 230 includes a case part 231 having a sirocco fan or another airflow generating portion 235 mounted thereon, the transfer material transporting member 250 arranged so as to surround the case part 231. In the transfer material transporting device 230, the airflow generating portion 235 is capable of expelling air from a space R2 in the case part 231 to the exterior of the case part 231.

A bottom surface of the case part 231 is a suction surface 232 having a plurality of air vents provided across the surface. An airflow indicated by B is generated at the suction surface 232 as a result of an air expulsion operation b of the airflow generating portion 235. Here, the action of partition members 233 provided in the case part 231 causes the expulsion of air from the space R2 in the case part 231 to be performed in a relatively even manner, so that the airflow at the suction surface 232 will not be uneven in certain locations.

The transfer material transporting member 250 provided so as to surround the case part 231 is an endless belt provided with a plurality of air vents (not shown) that penetrate from one main surface to another main surface. The transfer material transporting member 250 is stretched by a transfer material transporting member driving roller 251 and transfer material transporting member stretching rollers 252, 253, the transfer material transporting member driving roller 251 used for applying a driving force on the transfer material transporting member 250. Rotation of the transfer material transporting member driving roller 251 moves the transfer material transporting member 250 in the direction indicated by the arrow in the drawing. The speed of this movement is approximately the same as the speed of the image-forming process.

The suction force at the suction surface 232 of the case part 231 also acts through the air vents of the transfer material transporting member 250, whereby the transfer material S onto which a toner image has been transferred is held against gravity on a transporting surface P of the transfer material transporting member 250. The transfer material S is also transported along the transporting surface P as a result of the movement of the transfer material transporting member 250 caused by the driving force of the transfer material transporting member driving roller 251. The region of the transfer material transporting member 250 spanning from the transfer material transporting member stretching roller 252 to the transfer material transporting member driving roller 251 is used as the transporting surface P for transporting the transfer material S.

The second suction device 270 includes a case part 271 provided with a sirocco fan or another airflow generating portion 275 mounted thereto. The airflow generating portion 275 expels air from a space R3 in the case part 271 to the exterior of the case part 271. A bottom surface of the case part 271 is a suction surface 272 having a plurality of air vents provided across the surface. An air expulsion operation c of the airflow generating portion 275 of the second suction device 270 makes it possible to generate an airflow indicated by C. This airflow causes the transfer material S, onto which the toner image has been transferred, to be held on the suction surface 272 against gravity. The strength of the airflow is of a degree that causes the transfer material S to be held on the suction surface 272, but is not of a degree that counteracts the force involved with the transporting of the transfer material S and impedes the onward movement of the transfer material S.

The transfer material transporting means according to the present embodiment, including the first suction device 210, the transfer material transporting device 230, the second suction device 270, and other components, transports the transfer material with the surface of the first control mode onto which the toner image has been transferred facing vertically downwards.

An air-blowing device 400 discharges air into a space between the transfer belt 40 and the secondary transfer roller 61 in the vicinity of the exit of the secondary transfer nip. In the air-blowing device 400, a sirocco fan or another airflow generating portion 405 blows air into a space R4 in a case part 401. An opening part 402, extending in the axial direction of the rollers and similar components, is provided to the case part 401. Air blown into the case part 401 as a result of an airflow generating operation d of the airflow generating portion 405 is discharged from the opening part 402 as indicated by D. The force at which the air is discharged here is adjusted to a degree at which the transfer material S, onto which a toner image has been transferred, resists gravity and does not hang downwards; and at which the strength of the airflow does not cause the transfer material S to flutter.

Next, a description will be given for an operation of the transfer material transporting means in the present embodiment configured as described above. FIG. 9 shows a state immediately after the front end part in the direction of transportation of the transfer material S (SO) is ejected from the secondary transfer nip of the secondary transfer unit 60, i.e., immediately after the transfer material S has been delivered towards the transporting means from the side of the secondary transfer unit 60. As shown in the drawing, the transfer material S is held on the suction surface 212, without falling, by the airflow A at the suction surface 212 generated as a result of the operation a of the airflow generating portion 215; and transported, so as to slide along the suction surface 212, by the force of the feeding operation from the side towards the secondary transfer unit 60.

When the front end part in the direction of transportation of the transfer material S, which has been receiving the force of the feeding operation from the side towards the secondary transfer unit 60 and been transported as to slide along the suction surface 212, reaches the side towards the transfer material transporting device 230, the transfer material S is then held by the airflow B on the transporting surface P of the transfer material transporting member 250, and caused to move onward along the transporting surface P towards the fixing unit 90 as a result of the movement operation of the transfer material transporting member 250.

FIG. 10 shows a state immediately after the rear end part in the direction of transportation of the transfer material S (SE) is ejected from the secondary transfer nip of the secondary transfer unit 60. In particular, at this point, operating the air-blowing device 400 and discharging air as indicated by D makes it possible to prevent the rear end part of the transfer material S (SE) from coming into contact with the transfer belt 40 or another component and damaging the image when the rear end part of the transfer material (SE) is ejected from the secondary transfer nip.

The transfer material S shown in FIG. 10 is a transfer material having the greatest length in the direction of transportation that can be handled by the device. Dimensions of each of the structures are defined so that the transfer material S is sandwiched in neither the fixing nip of the fixing unit 90 nor the secondary transfer nip of the secondary transfer unit 60, even when the transfer material having the greatest length is used.

The transfer material S, having been transported along the transporting surface P of the transfer material transporting device 230, travels past the suction surface 272 of the second suction device 270, and enters the fixing nip formed by the heating roller 91 and the pressure-applying roller 92 in the fixing unit 90. The toner image is fused as a permanent visible image in the transfer material S that has travelled through the fixing nip.

Thus, the image-forming device and the image-forming method of the invention are configured so that the interaxial distance between the secondary transfer roller 61 and the belt-stretching roller 41 when the transfer material gripping pawl 611 grips the transfer material S is longer than the interaxial distance between the secondary transfer roller 61 and the belt-stretching roller 41 when the transfer material S is interposed between the secondary transfer roller 61 and the transfer belt 40. Therefore, it is possible to grip, in a stable manner, the transfer material S being fed from the feed member for feeding the transfer material S, and to reduce the incidence of failure to grip the transfer material S.

Figure 11:
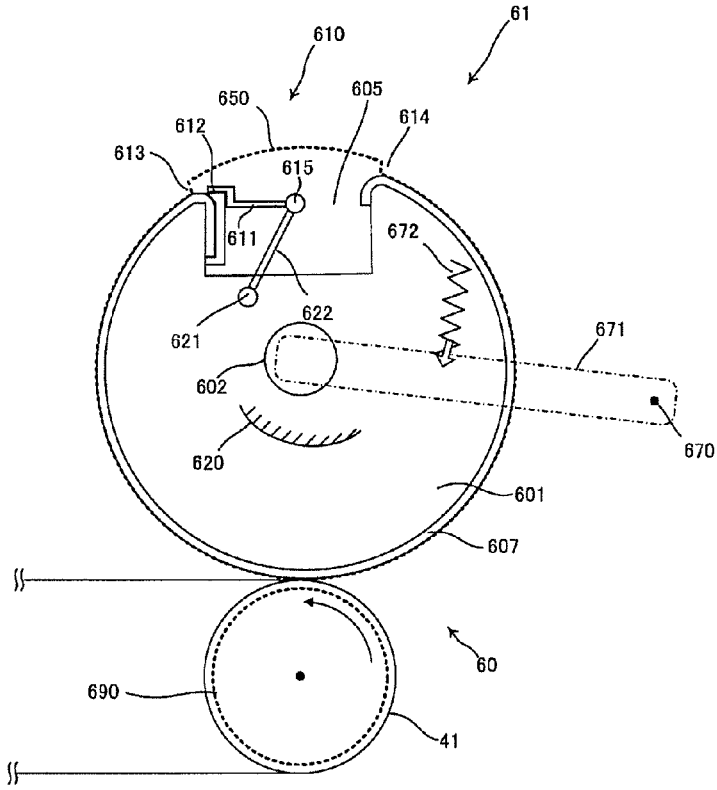
FIG. 11 illustrates an operation of a secondary transfer unit 60 used in an image-forming device according to a second embodiment of the present invention.

A second embodiment of the invention will now be described. The second embodiment has a different configuration of regulating members to the first embodiment described above. Also, in the second embodiment, a description will be given for a more detailed example of a mechanism for the transfer material gripping mechanism 610. Specifically, in the second embodiment, the configuration around the secondary transfer unit 60 has been modified in relation to the previous embodiment, and a description will therefore be given for the modified configuration. FIG. 11 illustrates the secondary transfer unit 60 in an image-forming device according to the second embodiment of the invention.

A description will now be given for a configuration of regulating members in the second embodiment. In the second embodiment, two regulating members 650 as shown in the drawing are provided at both ends of the roller shaft part 602 of the secondary transfer roller 61. Also, the contact member that is made to contact the regulating member 650 so as to receive the load from the secondary transfer roller 61 is a contact member 690 provided on a shaft part of the belt-stretching roller 41, rather than the frame member 671. For the contact member 690 in the second embodiment, a bearing or another member arranged coaxially in relation to the belt-stretching roller 41 is used. The contact member 690 is provided at both end parts in the axial direction of the belt-stretching roller 41.

In the claims, the structure including the position regulating member 650 and the contact member 690 is superordinated and referred to as an interaxial distance regulating portion. Also, in the claims, the position regulating members 650 is referred to as a "first regulating member" and the contact member 690 is referred to as a "second regulating member."

Also, a detailed description will be given for a mechanism for performing an opening and closing operation on the transfer material gripping pawl 611 in the transfer material gripping mechanism 610 with reference to FIG. 11. As shown in FIG. 11, the transfer material gripping pawl 611 is provided to the gripping pawl pivot 615 so as to rotate integrally with the gripping pawl pivot 615. A gripping pawl-controlling cam follower 621 is provided to one end part of the gripping pawl pivot 615 with an arm 622 interposed therebetween. Rotation of the secondary transfer roller 61 causes the gripping pawl-controlling cam follower 621 to be controlled by a gripping pawl-controlling cam 620, which is fixed to the main device body. The configuration is such that the front end part of the transfer material S, which has been fed via the transfer material feed guide 41 along the transfer material guide 102 from the gate rollers 101, 101', is gripped between the transfer material gripping pawl 611 and the pawl seat part 612 immediately before the first opening edge 613 arrives at the secondary transfer nip.

A description will now be given for an operation of the transfer material gripping mechanism 610 and a position-regulating operation based on the regulating member 650 according to the second embodiment configured as above. FIGS. 12 through 16 illustrate the secondary transfer unit 60 used in the image-forming device according to the second embodiment of the invention. Each of the drawings (A) is a drawing in which the secondary transfer unit 60 is viewed from the direction of the axis of the rollers, and each of the drawings (B) is a schematic diagram in which the secondary transfer unit 60 is viewed from a direction that is perpendicular to the axis of the rollers. The relationship regarding the interaxial distance between the secondary transfer roller 61 and the belt-stretching roller 41 in the second embodiment is the same as that shown in FIG. 8, which should therefore be referred to as necessary.

Figure 12:
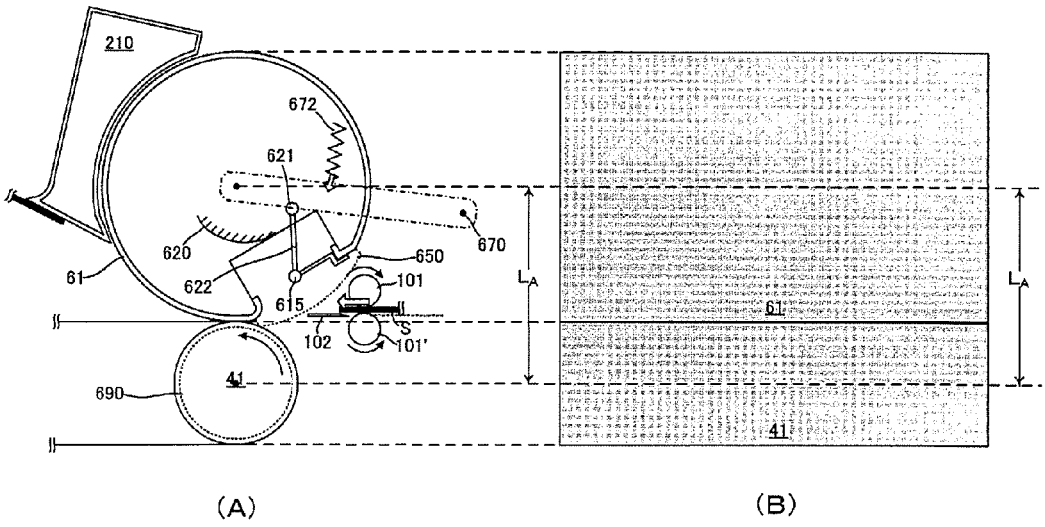
FIG. 12 illustrates an operation of the secondary transfer unit 60 used in the image-forming device according to the second embodiment of the present invention.

FIG. 12 shows a state in which the transfer material S is approaching the secondary transfer roller 61 along the transfer material guide 102 (i.e., phase A). Even in an instance in which printing is being performed continuously, in the phase shown in FIG. 12, neither transfer material that has already undergone transfer, nor any other transfer material, are present in the secondary transfer nip. In the phase shown in FIG. 12, the interaxial distance between the secondary transfer roller 61 and the belt-stretching roller 41 is in a state in which a predetermined distance $L_A$ is maintained. Also, in phase A, the gripping pawl-controlling cam follower 621 is not in contact with the gripping pawl-controlling cam 620, and the transfer material gripping pawl 611 is in a state of being closed relative to the pawl seat part 612.

From the state shown in FIG. 12, the regulating member 650 and the contact member 690 gradually start to contact each other, resulting in a state in which the regulating member 650 is subjected to an urging force/load from the secondary transfer roller 61 through the contact member 690. The transfer material gripping pawl 611 provided in the opening concaved portion 605 is thereby prevented from coming into contact with the transfer belt 40, even when the opening concaved portion 605 of the secondary transfer roller 61 arrives at a position facing the transfer belt 40.

Figure 13:
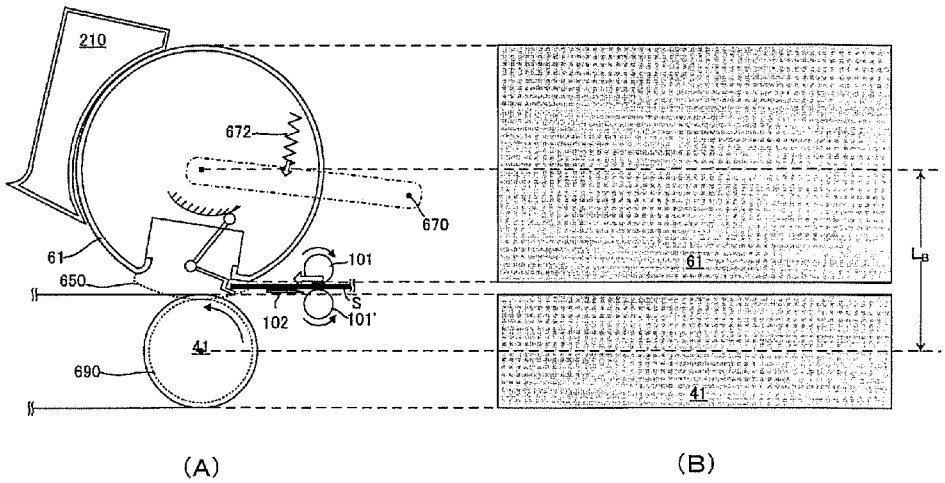
FIG. 13 illustrates an operation of the secondary transfer unit 60 used in the image-forming device according to the second embodiment of the present invention.

FIG. 13 shows a state of readiness for gripping the transfer material S approaching along the transfer material guide 102 (i.e., phase B). Specifically, the gripping pawl-controlling cam follower 621 comes into contact with the gripping pawl-controlling cam 620, and the transfer material gripping pawl 611 starts to move away from the pawl seat part 612 according to the profile provided to the gripping pawl-controlling cam 620 so that the clearance for gripping the transfer material S widens. Although the opening concaved portion 605 of the secondary transfer roller 61 is in a state of facing the transfer belt 40, the regulating member 650 is in contact with the contact member 690, whereby there exists a state in which a predetermined distance of $L_B$ is maintained as the interaxial distance between the secondary transfer roller 61 and the belt-stretching roller 41. Although the secondary transfer roller 61 is urged in a downward direction, there exists a state in which the urging force/load from the secondary transfer roller 61 is received by the regulating member 650 through the contact member 690. As for the operation of the transfer material gripping mechanism 610 in the opening concaved portion 605, the transfer material gripping pawl 611 has moved away from the pawl seat part 612 and released the gripping member, and a state of readiness for gripping the transfer material S is in effect. However, contact between the regulating member 650 and the contact member 690 causes the interaxial distance $L_B$ to be longer than the interaxial distance $L_A$, therefore widening the clearance for gripping the transfer material S. Therefore, it becomes possible to grip, in a stable manner, the transfer material S fed from the gate rollers 101, 101' for feeding the transfer material S, and to reduce the incidence of transfer material grip failure. Also, since the interaxial distance $L_B$ is configured so as to be longer than the interaxial distance $L_A$, the transfer material gripping pawl 611, which has moved away from the pawl seat part 612, does not come into contact with the transfer belt 40.

Figure 14:
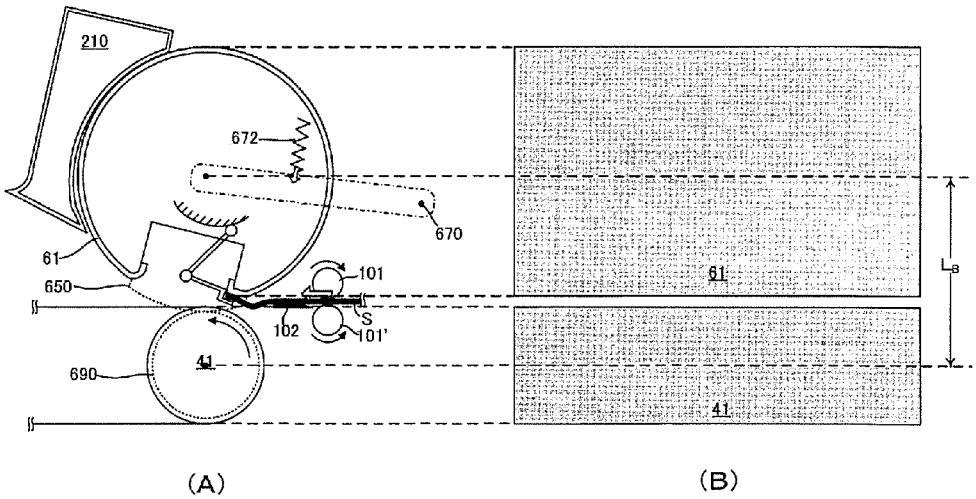
FIG. 14 illustrates an operation of the secondary transfer unit 60 used in the image-forming device according to the second embodiment of the present invention.

FIG. 14 shows a state in which the transfer material gripping pawl 611 of the transfer material gripping mechanism 610 is closed, whereby the transfer material S is gripped (i.e., phase B'). This operation of the transfer material gripping pawl 611 is achieved by the gripping pawl-controlling cam follower 621 sliding on the gripping pawl-controlling cam 620 having a predetermined profile. A configuration is present in which, in phase B', the regulating member 650 is again in contact with the contact member 690, whereby the distance of $L_B$ is maintained as the interaxial distance between the secondary transfer roller 61 and the belt-stretching roller 41. Having the interaxial distance be equal to interaxial distance $L_B$ makes it possible to prevent the transfer material gripping pawl 611 from coming into contact with the transfer belt 40 or to minimize occurrence of failure to grip the transfer material S, even when the transfer material gripping pawl 611 is undergoing a motion so as to grip the edge part of the transfer material S.

Figure 15:
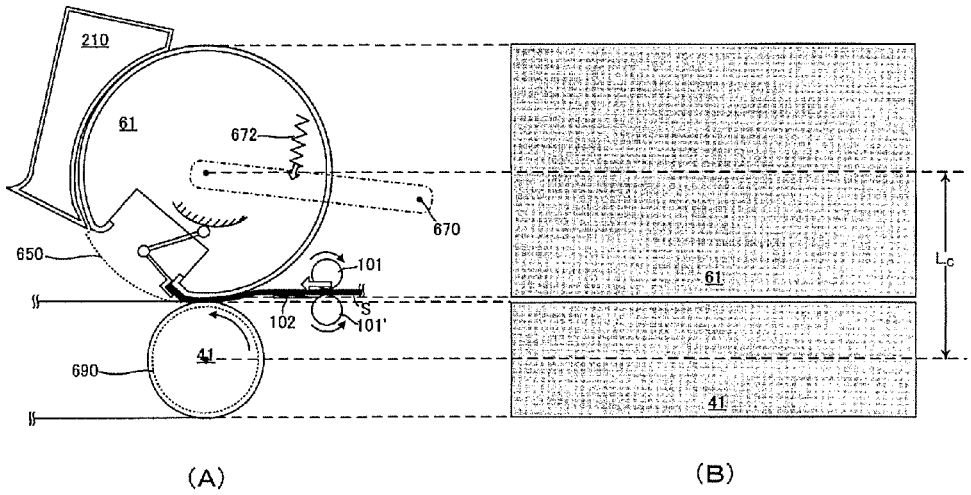
FIG. 15 illustrates an operation of the secondary transfer unit 60 used in the image-forming device according to the second embodiment of the present invention.

FIG. 15 shows a state in which the transfer material S, which has been gripped by the transfer material gripping mechanism 610, is being transported beyond the secondary transfer nip (i.e., phase C). Here, the gripping pawl-controlling cam 620 is provided with a profile that causes the transfer material gripping pawl 611 to operate so as to grip the transfer material S. The toner image layered on the transfer belt 40 is transferred onto the transfer material S passing through the secondary transfer nip. In phase C, the regulating member 650 and the contact member 690 are separated from each other, and the urging force/load from the secondary transfer roller 61 is directly acting as the transfer load. Although the regulating member 650 and the contact member 690 are not in contact with each other, the transfer material S passing through the secondary transfer nip is present in the secondary transfer nip. Therefore, a predetermined distance of $L_C$ is maintained as the interaxial distance between the secondary transfer roller 61 and the belt-stretching roller 41. The distance corresponding to the difference between the interaxial distance $L_A$ and the interaxial distance $L_C$ corresponds to the thickness of the transfer material S.

Figure 16:
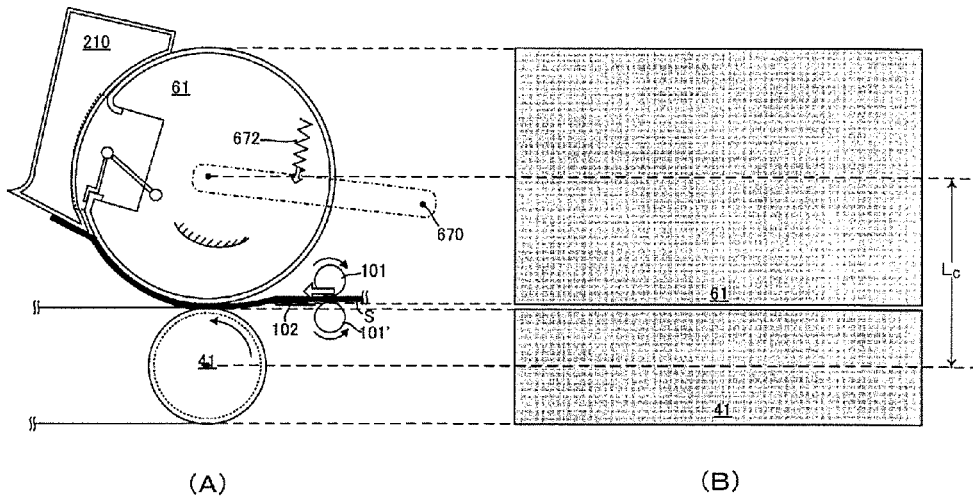
FIG. 16 illustrates an operation of the secondary transfer unit 60 used in the image-forming device according to the second embodiment of the present invention.

FIG. 16 shows a state in which the transfer material gripping mechanism 610 has released the transfer material S and the transfer material S has been delivered to the transfer material transporting means provided further downstream (i.e., phase C'). Here, the gripping pawl-controlling cam 620 on which the gripping pawl-controlling cam follower 621 slides between phase C and phase C' is provided with a profile that causes the transfer material gripping pawl 611 to operate so as to release the transfer material S. The transfer material S is thereby delivered to the transfer material transporting means on the downstream side. In phase C', again, the regulating member 650 and the contact member 690 are separated from each other, the urging force/load from the secondary transfer roller 61 acts as the transfer load, and the toner image layered on the transfer belt 40 is transferred on the transfer material S passing through the secondary transfer nip. Also, again in phase C', there exists a state in which a predetermined distance interaxial distance $L_C$ is maintained as the interaxial distance between the secondary transfer roller 61 and the belt-stretching roller 41.

Thus, according to the image-forming device (i.e., image-forming method) of the invention, the interaxial distance $L_B$ between the secondary transfer roller 61 and the belt-stretching roller 41 when the transfer material gripping pawl 611 grips the transfer material S is configured to be longer than the interaxial distance $L_C$ between the secondary transfer roller and the belt-stretching roller when the transfer material S is present between the secondary transfer roller 61 and the transfer belt 40. It thereby becomes possible to grip, in a stable manner, the transfer material S fed from the feeding member for feeding the transfer material S, and reduce the incidence of failure to grip the transfer material S.

A third embodiment of the invention will now be described. In relation to the second embodiment, the third embodiment has a different roller for applying an urging force when applying a transfer load on the secondary transfer portion. Also, the third embodiment differs from the second embodiment in that a belt-driving roller for driving the transfer belt 40 is separately provided. The third embodiment also differs from the second embodiment in that a tension roller is additionally provided to both the upstream side and the downstream side of the belt-stretching roller 41.

Figure 17:
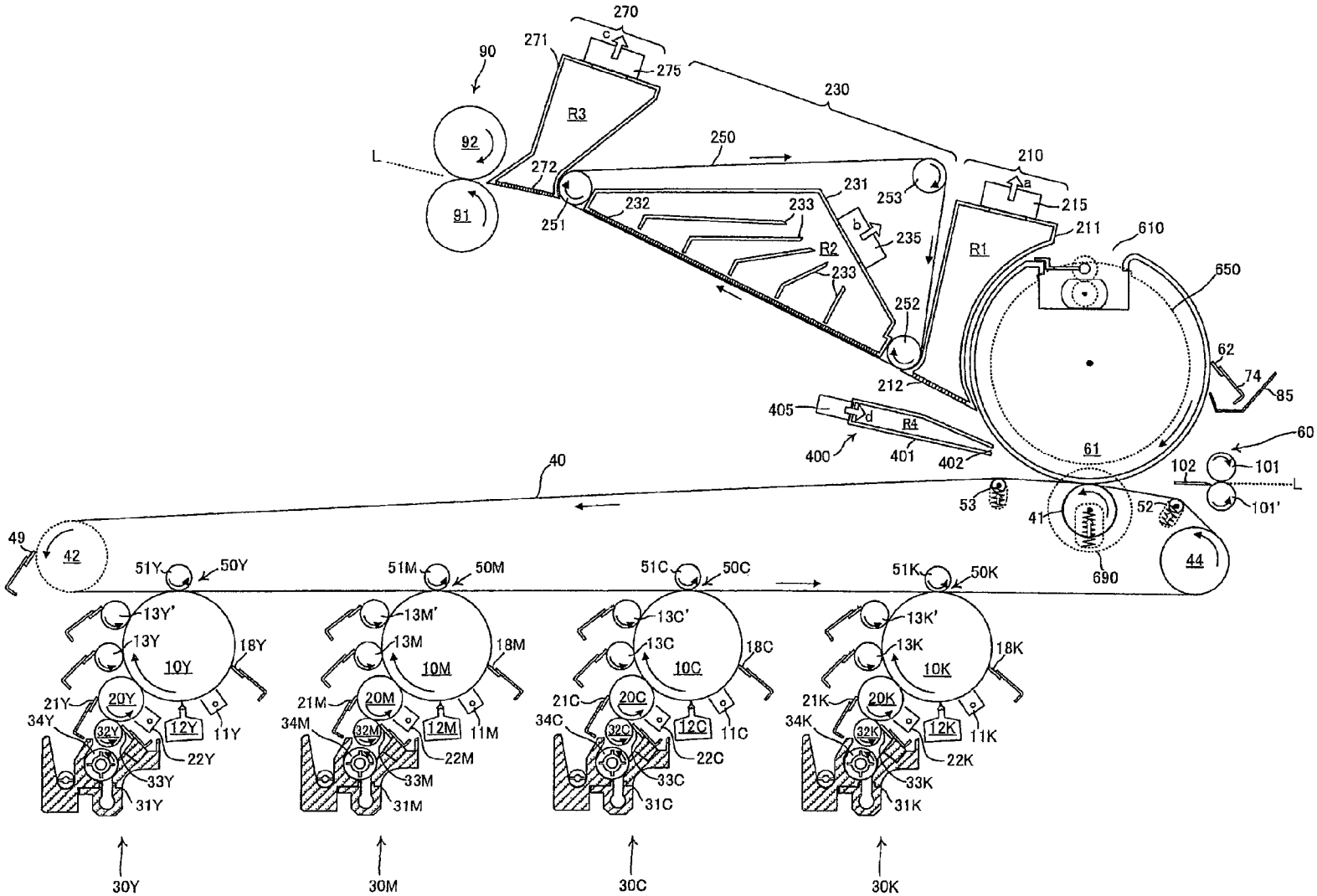
FIG. 17 is a drawing showing main constituent elements forming an image-forming device according to a third embodiment of the present invention.

The differences mentioned above will now be described with reference to the entire image-forming device. FIG. 17 is a drawing showing main constituent elements forming an image-forming device according to the third embodiment of the invention. In the secondary transfer unit 60 of the image-forming device according to the third embodiment, the belt-stretching roller 41 is urged in a direction indicated by the arrow in FIG. 17 (i.e., upwards), thereby making it possible to apply an appropriate transfer load on the secondary transfer nip portion. In the third embodiment, as with the second embodiment, a position regulating member 650 that rotates with the rotation of the secondary transfer roller 61 is provided to the rotation axis of the secondary transfer roller 61. The position regulating member 650 comes into contact with a bearing or another contact member 690 provided on the side of the belt-stretching roller 41, thereby maintaining the distance relative to the transfer belt 40 at a predetermined phase.

In the image-forming device according to the third embodiment, a belt-driving roller 44 for driving the transfer belt 40 is provided directly downstream of the developing device 30K, thereby making it possible to perform the primary transfer of toner images developed in the developing devices 30Y, 30M, 30C, 30K onto the transfer belt 40 in a stable manner. Also, a tension roller 52 is provided between the belt-stretching roller 41 and the belt-driving roller 44, and a tension roller 53 is provided directly downstream of the belt-stretching roller 41. The tension rollers absorb the displacement of the transfer belt 40 that accompanies movement of the belt-stretching roller 41, thereby preventing the displacement from being transmitted to the primary transfer portions or to each of the developing devices.

Figure 18:
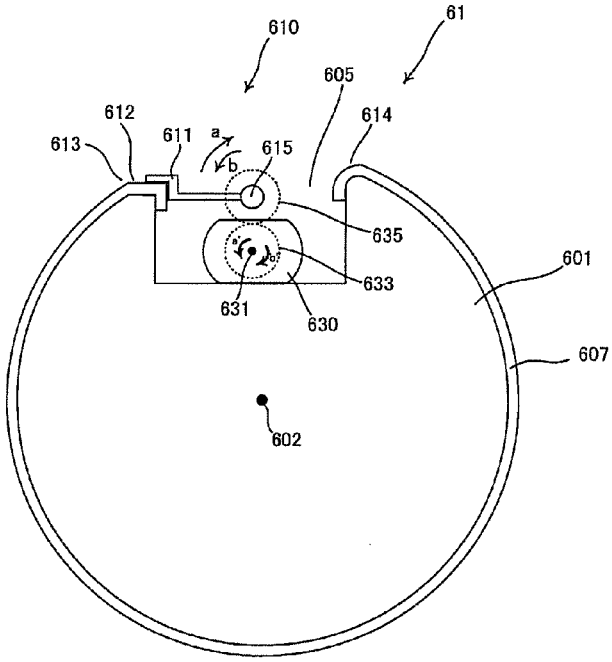
FIG. 18 illustrates a secondary transfer roller used in the image-forming device according to the third embodiment of the present invention.

The configuration of the secondary transfer roller 61 used in the third embodiment is also different in relation to the second embodiment, and this difference will also be described with reference to FIG. 18. FIG. 18 illustrates the secondary transfer roller used in the image-forming device according to the third embodiment of the invention. In FIG. 18, 601 represents the roller body part, 602 represents the roller shaft part, 605 represents the opening concaved portion, 607 represents the sheet material, 610 represents the transfer material gripping mechanism, 611 represents the transfer material gripping pawl, 612 represents the pawl seat part, 613 represents the first opening edge, 614 represents the second opening edge, 615 represents the gripping pawl pivot, 630 represents a motor, 631 represents a rotor shaft, 633 represents a first gear, and 635 represents a second gear.

While a cam mechanism is used in the operation of the transfer material gripping mechanism 610 according to the second embodiment, an electromagnetic mechanism is used in the operation of the transfer material gripping mechanism 610 according to the third embodiment. More specifically, the transfer material gripping mechanism 610 according to the third embodiment has a motor 630 as a source of power for opening and closing the transfer material gripping pawl 611. The motor 630 is configured so as to be capable of rotating in the clockwise direction (i.e., the direction indicated by b') or the counterclockwise direction (i.e., the direction indicated by a') according to a control signal from control means (not shown). The first gear 633 is provided to the rotor shaft 631 of the motor 630, and the second gear 635 that engages with the first gear 633 is provided to the gripping pawl pivot 615 of the transfer material gripping pawl 611, so that the rotation force from the rotor shaft 631 is transmitted to the gripping pawl pivot 615, thereby causing the transfer material gripping pawl 611 to undergo a pivotal motion.

When the motor 630 rotates in the clockwise direction (i.e., the direction indicated by b'), the transfer material gripping pawl 611 moves in the direction indicated by b and undergoes a motion so as to grip the edge part of the transfer material between the transfer material gripping pawl 611 and the pawl seat part 612. When the motor 630 rotates in the counterclockwise direction (i.e., the direction indicated by a'), the transfer material gripping pawl 611 moves in the direction indicated by a, and the transfer material gripping pawl 611 moves away from the pawl seat part 612 and undergoes a motion so as to release the gripped transfer material.

Although in the present embodiment, a motor is used as an electromagnetic component to be used as a power source, a rotary solenoid or another electromagnetic component for generating a rotating motion may be used. Alternatively, an actuator or another electromagnetic component for generating a linear motion may be used to operate the transfer material gripping pawl 611.

Figure 19:
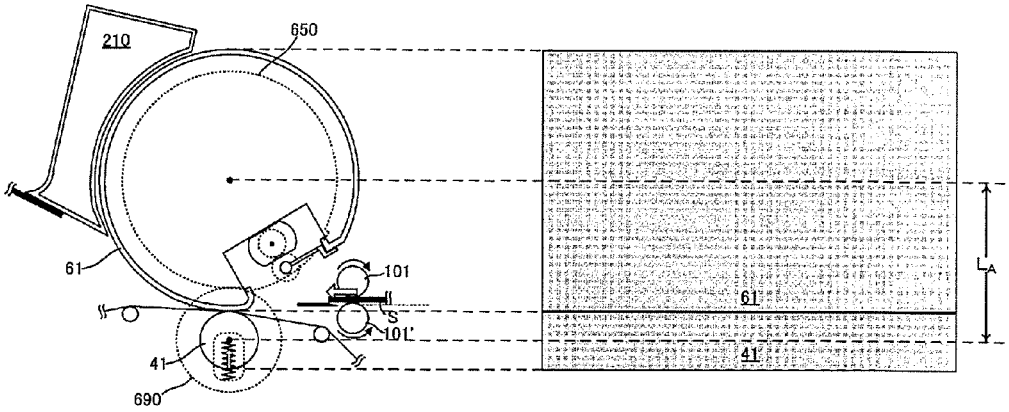
FIG. 19 illustrates an operation of the secondary transfer unit 60 used in the image-forming device according to the third embodiment of the present invention.
Figure 24:
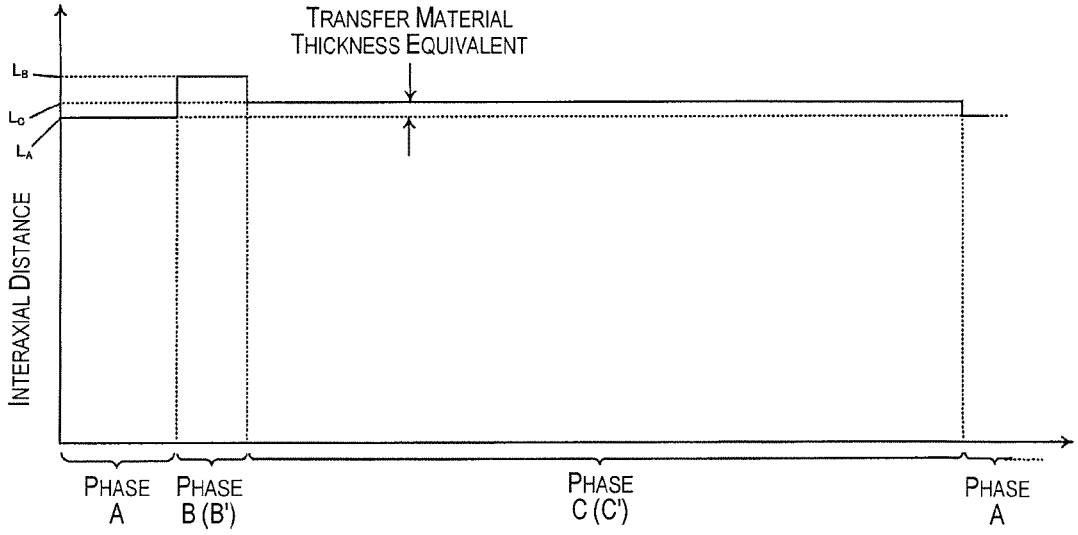
FIG. 24 illustrates the distance between the axial center of a secondary transfer roller 61 and a belt-stretching roller 41 according to the third embodiment of the present invention.

Next, a description will be given for an operation of the transfer material gripping mechanism 610 according to the third embodiment configured as above and a position-regulating operation based on the regulating member 650. FIGS. 19 though 23 illustrate an operation of the secondary transfer unit 60 used in the image-forming device according to the third embodiment of the invention. Each of the drawings (A) is a drawing in which the secondary transfer unit 60 is viewed from the axial direction of the rollers, and each of the drawings (B) is a schematic diagram in which the secondary transfer unit 60 is viewed from a direction that is perpendicular to the axis of the rollers. FIG. 24 illustrates the distance between the axial center of the secondary transfer roller 61 and the belt-stretching roller 41 according to the third embodiment.

FIG. 19 shows a state in which the transfer material S is approaching the secondary transfer roller 61 along the transfer material guide 102 (i.e., phase A in FIG. 24). Even in an instance in which printing is being performed continuously, in the phase shown in FIG. 19, neither transfer material that has already undergone transfer, nor any other transfer material, are present in the secondary transfer nip. In the phase shown in FIG. 19, the interaxial distance between the secondary transfer roller 61 and the belt-stretching roller 41 is in a state in which a predetermined distance $L_A$ is maintained. Also, in phase A, no control signal is issued to the motor 630, and the transfer material gripping pawl 611 and the pawl seat part 612 are maintained in a state of being in contact with each other.

From this state, the regulating member 650 and the contact member 690 gradually start to contact each other, resulting in a state in which the regulating member 650 is subjected to an urging force/load from the secondary transfer roller 61 through the contact member 690. The transfer material gripping pawl 611 provided in the opening concaved portion 605 is thereby prevented from coming into contact with the transfer belt 40, even when the opening concaved portion 605 of the secondary transfer roller 61 arrives at a position facing the transfer belt 40.

Figure 20:
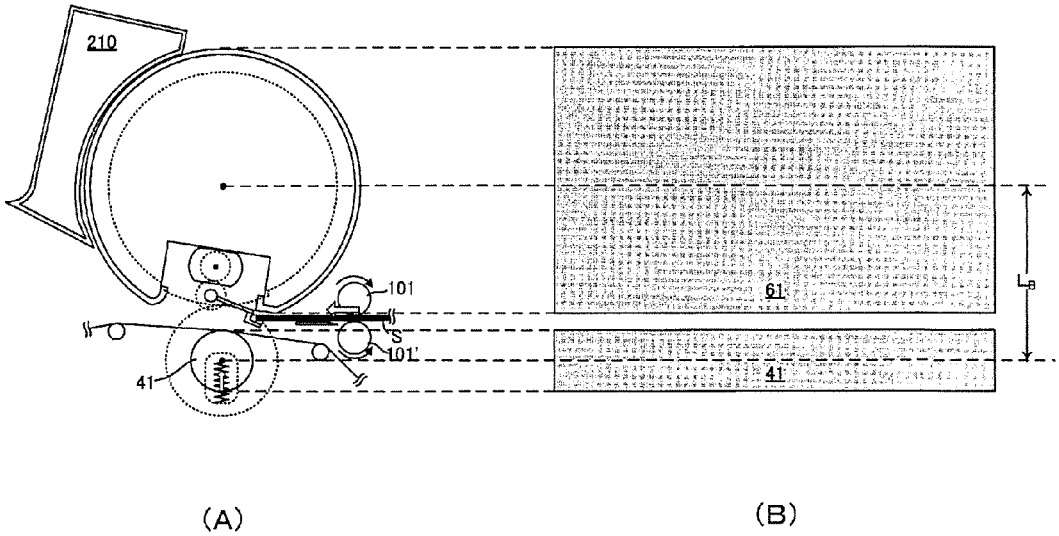
FIG. 20 illustrates an operation of the secondary transfer unit 60 used in the image-forming device according to the third embodiment of the present invention.

FIG. 20 shows a state of readiness for gripping the transfer material S approaching along the transfer material guide 102 (i.e., phase B in FIG. 24). Specifically, the motor 630 receives a control signal and rotates in the counterclockwise direction (i.e., the direction indicated by a'), and the transfer material gripping pawl 611 starts to move away from the pawl seat part 612 so that the clearance for gripping the transfer material S widens. Although the opening concaved portion 605 of the secondary transfer roller 61 is in a state of facing the transfer belt 40, the regulating member 650 is in contact with the contact member 690, whereby there exists a state in which a predetermined distance of $L_B$ is maintained as the interaxial distance between the secondary transfer roller 61 and the belt-stretching roller 41. Although the secondary transfer roller 61 is urged in a downward direction, there exists a state in which the urging force/load from the secondary transfer roller 61 is received by the regulating member 650 through the contact member 690. As for the operation of the transfer material gripping mechanism 610 in the opening concaved portion 605, the transfer material gripping pawl 611 has moved away from the pawl seat part 612 and released the gripping member, and a state of readiness for gripping the transfer material S is in effect. However, contact between the regulating member 650 and the contact member 690 causes the interaxial distance $L_B$ to be longer than the interaxial distance $L_A$, therefore widening the clearance for gripping the transfer material S. Therefore, it becomes possible to grip, in a stable manner, the transfer material S fed from the gate rollers 101, 101' for feeding the transfer material S, and to reduce the incidence of transfer material grip failure. Also, since the interaxial distance $L_B$ is configured so as to be longer than the interaxial distance $L_A$, the transfer material gripping pawl 611, which has moved away from the pawl seat part 612, does not come into contact with the transfer belt 40.

Figure 21:
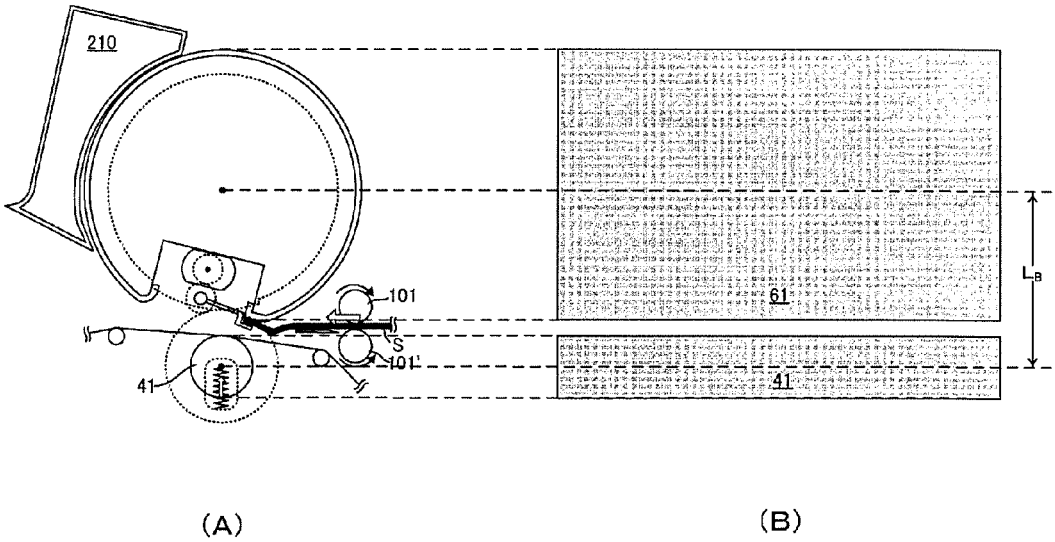
FIG. 21 illustrates an operation of the secondary transfer unit 60 used in the image-forming device according to the third embodiment of the present invention.

FIG. 21 shows a state in which the transfer material gripping pawl 611 of the transfer material gripping mechanism 610 is closed, whereby the transfer material S is gripped (i.e., phase if in FIG. 24). Specifically, the motor 630 receives the control signal, rotates in the clockwise direction (i.e., the direction indicated by b'), and undergoes a motion so as to grip the edge part of the transfer material between the transfer material gripping pawl 611 and the pawl seat part 612. A configuration is present in which, in phase B', the regulating member 650 is again in contact with the contact member 690, whereby the distance of $L_B$ is maintained as the interaxial distance between the secondary transfer roller 61 and the belt-stretching roller 41. Having the interaxial distance be equal to interaxial distance $L_B$ makes it possible to prevent the transfer material gripping pawl 611 from coming into contact with the transfer belt 40 or to minimize occurrence of failure to grip the transfer material S, even when the transfer material gripping pawl 611 is undergoing a motion so as to grip the edge part of the transfer material S.

Figure 22:
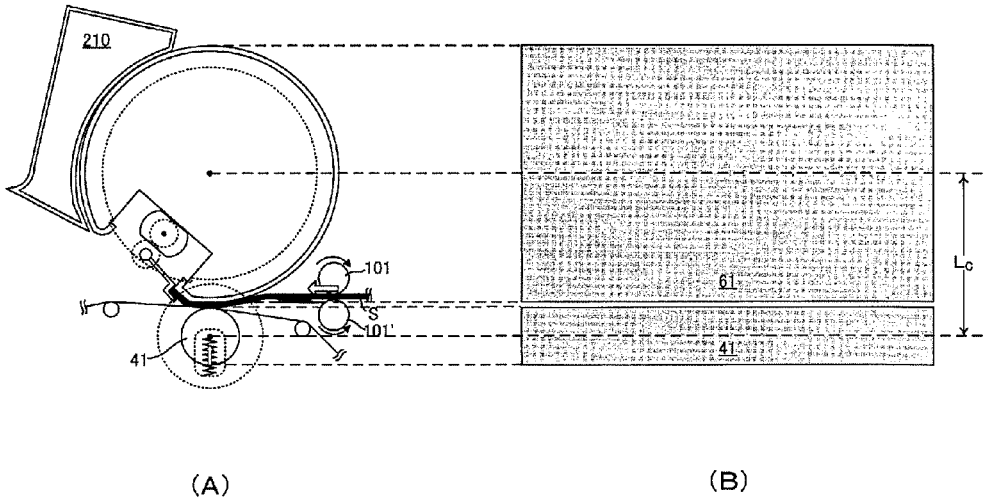
FIG. 22 illustrates an operation of the secondary transfer unit 60 used in the image-forming device according to the third embodiment of the present invention.

FIG. 22 shows a state in which the transfer material S, which has been gripped by the transfer material gripping mechanism 610, is being transported beyond the secondary transfer nip (i.e., phase C in FIG. 24). Here, the motor 630 is controlled so that the transfer material gripping pawl 611 maintains the gripping of the transfer material S. The toner image layered on the transfer belt 40 is transferred onto the transfer material S passing through the secondary transfer nip. In phase C, the regulating member 650 and the contact member 690 are separated from each other, and the urging force/load from the secondary transfer roller 61 is directly acting as the transfer load. Although the regulating member 650 and the contact member 690 are not in contact with each other, the transfer material S passing through the secondary transfer nip is present in the secondary transfer nip. Therefore, a predetermined distance of $L_C$ is maintained as the interaxial distance between the secondary transfer roller 61 and the belt-stretching roller 41. The distance corresponding to the difference between the interaxial distance $L_A$ and the interaxial distance $L_C$ is the thickness of the transfer material S.

Figure 23:
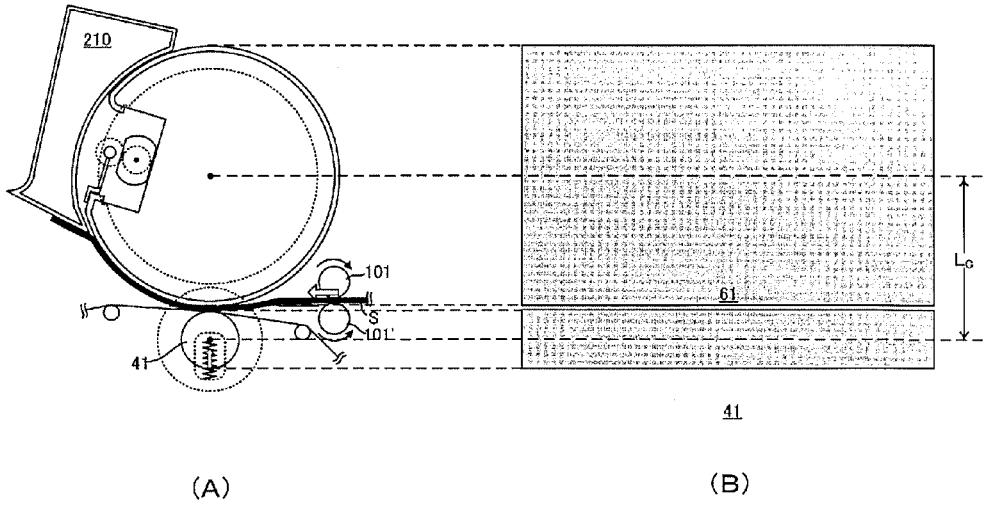
FIG. 23 illustrates an operation of the secondary transfer unit 60 used in the image-forming device according to the third embodiment of the present invention.

FIG. 23 shows a state in which the transfer material gripping mechanism 610 has released the transfer material S and the transfer material S has been delivered to the transfer material transporting means provided further downstream (i.e., phase C' in FIG. 24). The motor 630, which has received a control signal at an appropriate timing between phase C and phase C', rotates in the counterclockwise direction (i.e., the direction indicated by a') and performs an operation to release the transfer material S from the transfer material gripping pawl 611. The transfer material S is thereby delivered to the transfer material transporting means on the downstream side. In phase C, again, the regulating member 650 and the contact member 690 are separated from each other, the urging force/load from the secondary transfer roller 61 acts as the transfer load, and the toner image layered on the transfer belt 40 is transferred on the transfer material S passing through the secondary transfer nip. Also, again in phase C', there exists a state in which a predetermined distance interaxial distance $L_C$ is maintained as the interaxial distance between the secondary transfer roller 61 and the belt-stretching roller 41.

Thus, according to the image-forming device (i.e., image-forming method) of the invention, the interaxial distance $L_B$ between the secondary transfer roller 61 and the belt-stretching roller 41 when the transfer material gripping pawl 611 grips the transfer material S is configured to be longer than the interaxial distance $L_C$ between the secondary transfer roller and the belt-stretching roller when the transfer material S is present between the secondary transfer roller 61 and the transfer belt 40. It thereby becomes possible to grip, in a stable manner, the transfer material S fed from the feeding member for feeding the transfer material S, and reduce the incidence of failure to grip the transfer material S.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image-forming device comprising:

an image carrier belt that carries an image;

a roller that winds the image carrier belt;

a transfer material transporting member that transports a transfer material; and a transfer roller that transfers the image to the transfer material at a nip, the transfer roller including a concaved portion formed on a peripheral surface thereof and a transfer material gripping portion that grips the transfer material in the concaved portion, the nip being formed between the transfer roller and the roller, the transfer roller being in contact with the roller via the image carrier belt, a first interaxial distance between a rotation axis of the transfer roller and a rotation axis of the roller as the transfer material is gripped by the transfer material gripping portion being larger than a second interaxial distance between the rotation axis of the transfer roller and the rotation axis of the roller as the image is being transferred onto the transfer material at the nip.

2. The image-forming device according to claim 1, further comprising an interaxial distance regulating portion that regulates the first interaxial distance between the rotation axis of the transfer roller and the rotation axis of the roller.

3. The image-forming device according to claim 2, wherein the interaxial distance regulating portion includes a first regulating member and a second regulating member, the first regulating member is configured at an end part in an axial direction of the transfer roller, the second regulating member is in contact with the first regulating member when the first interaxial distance is regulated, and the first regulating member and the second regulating member do not contact with each other when the image is being transferred to the transfer material at the nip.

4. The image-forming device according to claim 3, further comprising a roller support portion that supports a shaft member of the roller and that shift the interaxial distance between the rotation axis of the transfer roller and the rotation axis of the roller, wherein the shaft member that pivotally supports the second regulating member.

5. The image-forming device according to claims 1, wherein the transfer material gripping portion includes a gripping member and a support member that supports the gripping member;

the image-forming device includes a cam mechanism that moves the gripping member in accordance with rotation of the transfer roller.

6. An image-forming method comprising:

carrying an image on an image carrier belt wound by a roller;

transporting a transfer material;

gripping the transfer material with a transfer material gripping portion provided to a concaved portion on a peripheral surface of a transfer roller when an interaxial distance between a rotation axis of the transfer roller and a rotation axis of the roller is equal to a first interaxial distance;

positioning the transfer roller and the roller, after the transfer material has been gripped with a transfer material gripping portion, so that the interaxial distance between the rotation axis of the transfer roller and the rotation axis of the roller is equal to a second interaxial distance that is shorter than the first interaxial distance; and transferring the image on the image carrier belt to the transfer material at a nip formed by causing the transfer roller to contact with the roller via the image carrier belt.

7. The image-forming method according to claim 6, further comprising moving the position of the transfer roller after the transfer material has been gripped by the transfer material gripping portion; and shifting the interaxial distance between the rotation axis of the transfer roller and the rotation axis of the roller from the first distance to the second distance after the transfer material has been gripped by the transfer material gripping portion.

8. The image-forming method according to claim 6, further comprising moving the position of the roller after the transfer material has been gripped by the transfer material gripping portion; and shifting the interaxial distance between the rotation axis of the transfer roller and the rotation axis of the roller from the first distance to the second distance after the transfer material has been gripped by the transfer material gripping portion.

* * * * *